US009817341B2

(12) United States Patent
Ohsugi et al.

(10) Patent No.: US 9,817,341 B2
(45) Date of Patent: Nov. 14, 2017

(54) IMAGE FORMING APPARATUS

(71) Applicants: Tatsuya Ohsugi, Kanagawa (JP); Kenji Sugiura, Kanagawa (JP); Hirokazu Ishii, Tokyo (JP); Hiroyoshi Haga, Kanagawa (JP); Naohiro Kumagai, Kanagawa (JP); Seiichi Kogure, Kanagawa (JP); Takehide Mizutani, Tokyo (JP); Junpei Fujita, Kanagawa (JP); Yuuji Wada, Kanagawa (JP); Kazuki Yogosawa, Kanagawa (JP); Naoto Kochi, Kanagawa (JP)

(72) Inventors: Tatsuya Ohsugi, Kanagawa (JP); Kenji Sugiura, Kanagawa (JP); Hirokazu Ishii, Tokyo (JP); Hiroyoshi Haga, Kanagawa (JP); Naohiro Kumagai, Kanagawa (JP); Seiichi Kogure, Kanagawa (JP); Takehide Mizutani, Tokyo (JP); Junpei Fujita, Kanagawa (JP); Yuuji Wada, Kanagawa (JP); Kazuki Yogosawa, Kanagawa (JP); Naoto Kochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/073,983

(22) Filed: Mar. 18, 2016

(65) Prior Publication Data

US 2016/0274505 A1 Sep. 22, 2016

(30) Foreign Application Priority Data

Mar. 18, 2015 (JP) ..... 2015-054477
Oct. 5, 2015 (JP) ..... 2015-197550

(51) Int. Cl.
*G03G 15/20* (2006.01)
*G03G 15/16* (2006.01)

(52) U.S. Cl.
CPC ..... *G03G 15/1665* (2013.01); *G03G 15/1605* (2013.01); *G03G 15/1675* (2013.01);
(Continued)

(58) Field of Classification Search
USPC ..... 399/38, 66, 88, 297–299, 302, 308, 310, 399/314
See application file for complete search history.

(56) References Cited

U.S. PATENT DOCUMENTS 5,812,919 A 9/1998 Takano et al.
6,282,386 B1 8/2001 Ishii
(Continued)

FOREIGN PATENT DOCUMENTS

JP 2011-013241 1/2011
JP 2013-033205 2/2013
JP 2014-010383 1/2014

OTHER PUBLICATIONS

U.S. Appl. No. 14/881,611, filed Oct. 13, 2015.

*Primary Examiner* — Hoan Tran
(74) *Attorney, Agent, or Firm* — Oblon, McClelland, Maier & Neustadt, L.L.P.

(57) ABSTRACT

An image forming apparatus includes a plurality of image bearers, a transfer bias member, and a power source. When the transfer bias member transfers a color toner image onto a recording sheet, a second peak value of a peak-to-peak of a transfer bias, which is smaller than a first peak value of the peak-to-peak in an electrostatic force to move toner from the image bearers or an intermediate transfer body to the recording sheet, is zero or has a first polarity to generate the electrostatic force in a transfer direction to move toner from the image bearers or the intermediate transfer body to the recording sheet. When the transfer bias member transfers a monochromatic toner image including only black toner onto the recording sheet, the second peak value is zero or has a
(Continued)

second polarity to generate an electrostatic force in an opposite direction to the transfer direction.

20 Claims, 10 Drawing Sheets

(52) U.S. Cl.
CPC ..... *G03G 2215/0129* (2013.01); *G03G 2215/1623* (2013.01)

(56) References Cited

U.S. PATENT DOCUMENTS 7,978,998 B2 * 7/2011 Nakagawa ..... G03G 21/0047 399/101
8,818,221 B2 * 8/2014 Ogino ..... G03G 15/1675 399/122
8,891,996 B2 * 11/2014 Fujita ..... G03G 15/00 399/88
9,274,461 B2 * 3/2016 Kato ..... G03G 15/1675
9,310,722 B2 * 4/2016 Tanaka ..... G03G 15/0131
9,488,937 B2 * 11/2016 Tanaka ..... G03G 15/0189
2003/0035658 A1 2/2003 Ishii
2007/0212139 A1 9/2007 Sugiura et al.
2008/0310897 A1 12/2008 Naruse et al.
2010/0008706 A1 1/2010 Sugiura et al.
2010/0040386 A1 2/2010 Mizutani et al.
2011/0103822 A1 5/2011 Sugiura et al.
2011/0229187 A1 9/2011 Hozumi et al.
2012/0008973 A1 1/2012 Sakakibara et al.
2012/0237271 A1 9/2012 Sengoku et al.
2012/0308250 A1 12/2012 Shimizu et al.
2012/0315058 A1 12/2012 Shimizu et al.
2013/0004190 A1 1/2013 Sengoku et al.
2013/0011155 A1 1/2013 Ogiyama et al.
2013/0089363 A1 4/2013 Mimbu et al.
2013/0136468 A1 5/2013 Shimizu et al.
2013/0136477 A1 5/2013 Ogiyama et al.
2013/0177329 A1 7/2013 Tanaka et al.
2013/0236201 A1 9/2013 Mizutani et al.
2013/0308968 A1 11/2013 Tanaka et al.
2014/0029988 A1 1/2014 Shimizu et al.
2014/0064769 A1 3/2014 Sugiura
2014/0241744 A1 8/2014 Ichikawa et al.
2014/0270819 A1 9/2014 Wada et al.
2014/0314435 A1 10/2014 Kato et al.
2016/0041508 A1 2/2016 Kogure et al.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2015-054477, filed on Mar. 18, 2015, and 2015-197550, filed on Oct. 5, 2015, in the Japan Patent Office, the entire disclosure of each of which is hereby incorporated by reference herein.

BACKGROUND

Technical Field

Aspects of this disclosure relate to an image forming apparatus.

Related Art

An image forming apparatus is known that bears toner images on a plurality of image bearers and applies a transfer bias including an alternating current component to a transfer bias member to transfer the toner images directly or via an intermediate transferor onto a recording sheet.

Such an image forming apparatus includes, for example, four photoconductors as the image bearers to separately form an yellow (Y) toner image, a magenta (M) toner image, a cyan (C) toner image, and a black (K) toner image. After primarily transferring the Y toner image, the M toner image, C toner image, and the K toner image in a superimposing manner, the image forming apparatus secondarily transfers the superimposed toner images onto a recording sheet in a secondary transfer portion in which an intermediate transfer belt and a secondary transfer roller contact each other. In such a case, a secondary transfer bias in which an alternating current bias is superimposed on a direct current bias is applied to the secondary transfer roller. Such a configuration is intended to more effectively reduce occurrence of a transfer failure due to reverse charging of toner during transfer than a configuration using a secondary transfer bias including only a direct current voltage.

SUMMARY

In an aspect of this disclosure, there is provided an image forming apparatus that includes a plurality of image bearers, a transfer bias member, and a power source. The plurality of image bearers bears toner images of different colors. The transfer bias member transfers the toner images from the plurality of image bearers onto a recording sheet directly or via an intermediate transfer body. The power source applies a transfer bias including an alternating current component to the transfer bias member to transfer the toner images onto the recording sheet. When the transfer bias member transfers a color toner image including black toner and non-black toner onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet. When the transfer bias member transfers a monochromatic toner image including only the black toner onto the recording sheet, the second peak value is zero or has a second polarity to generate an electrostatic force in an opposite direction to the transfer direction.

In another aspect of this disclosure, there is provided an image forming apparatus that includes a plurality of image bearers, a transfer bias member, and a power source. The plurality of image bearers bears toner images of different colors. The transfer bias member transfers the toner images from the plurality of image bearers onto a recording sheet directly or via an intermediate transfer body. The power source applies a transfer bias including an alternating current component to the transfer bias member to transfer the toner images onto the recording sheet. When the transfer bias member transfers a most upstream toner image from a most upstream image bearer in a transfer process of the toner images onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet. When the transfer bias member transfers only a most downstream toner image from a most downstream image bearer in the transfer process onto the recording sheet, the second peak value is zero or has a second polarity to generate an electrostatic force in an opposite direction to the transfer direction.

In another aspect of this disclosure, there is provided an image forming apparatus that includes a plurality of image bearers, a transfer bias member, and a power source. The plurality of image bearers bears toner images of different colors. The transfer bias member transfers the toner images from the plurality of image bearers onto a recording sheet directly or via an intermediate transfer body. The power source applies a transfer bias including an alternating current component to the transfer bias member to transfer the toner images onto the recording sheet. When the transfer bias member transfers onto the recording sheet a largest-charge-amount toner image having a largest charge amount of toner of the toner images before transfer onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet. When the transfer bias member transfers onto the recording sheet only a smallest-charge-amount toner image having a smallest charge amount of toner of the toner images before transfer onto the recording sheet, the second peak value is zero or has a second polarity to generate an electrostatic force in an opposite direction to the transfer direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 11 is a block diagram of main portions of the electrical circuit of the secondary transfer power source in an image forming apparatus according to a second embodiment in combination with the secondary-transfer first roller 33, the secondary-transfer second roller 36, and the like;

DETAILED DESCRIPTION

Figure 1:
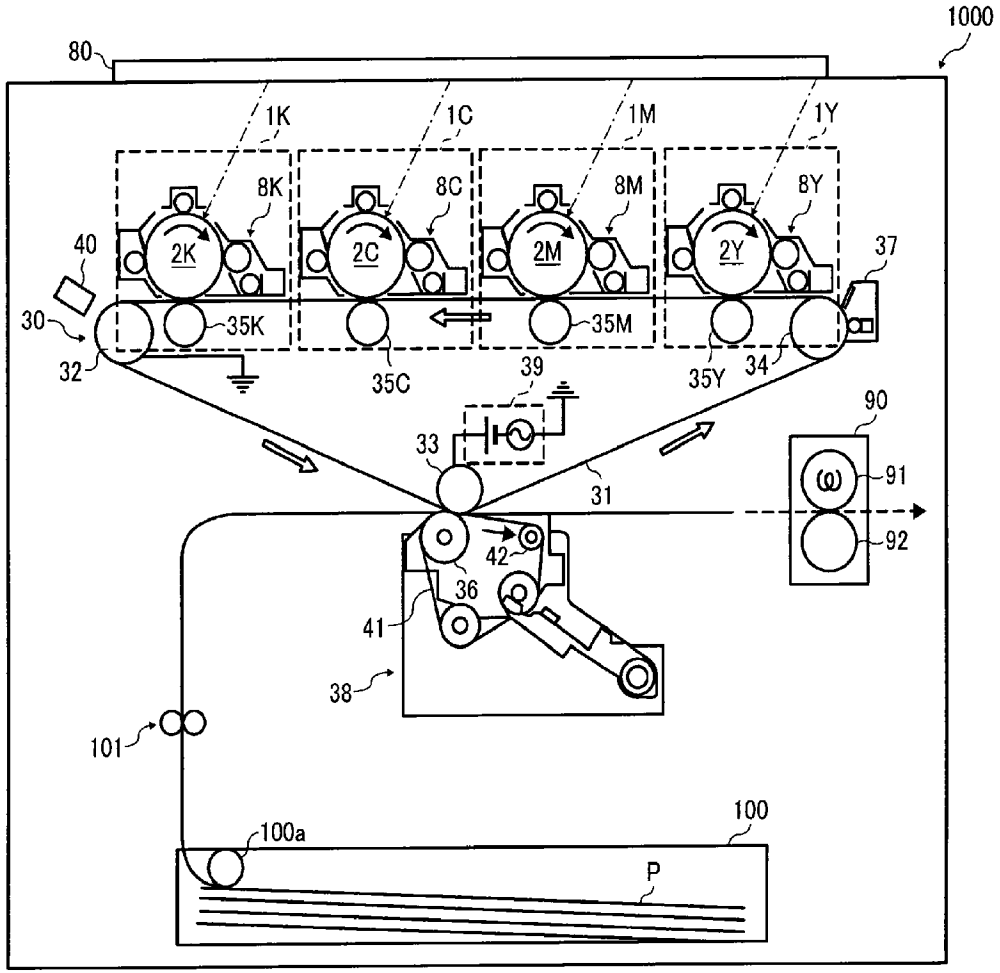
FIG. 1 is a schematic view of a printer as an example of an image forming apparatus according to a first embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

With reference to FIG. 1, a description is provided of an electrophotographic color printer as an example of an image forming apparatus 1000 according to a first embodiment of the present disclosure. First, a configuration of the image forming apparatus 1000 according to a first embodiment of the present disclosure is described below. FIG. 1 is a schematic view of a printer as an example of the image forming apparatus 1000. As illustrated in FIG. 1, the image forming apparatus 1000 according to the first embodiment includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 1000 also includes a transfer unit 30 serving as a transfer device, an optical writing unit 80, a fixing device 90, a sheet cassette 100, and a pair of registration rollers 101.

Figure 2:
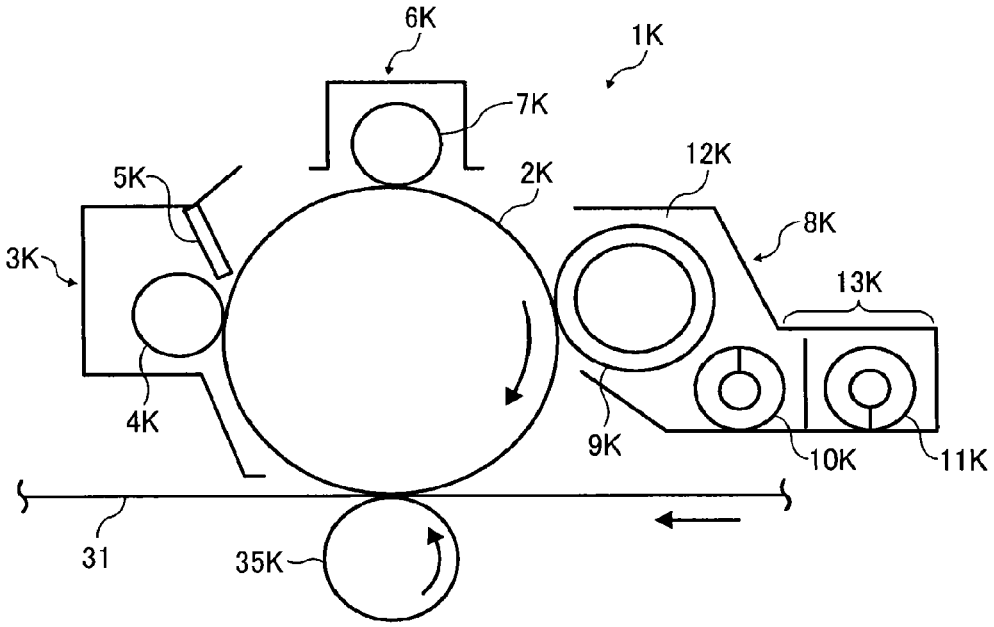
FIG. 2 is an enlarged view of a toner image forming unit for black color in the image forming apparatus of FIG. 1.

The toner image forming units 1Y, 1M, 1C, and 1K all have the same configuration as all the others, differing only in the color of toner employed. Thus, a description is provided of the toner image forming unit 1K for forming a toner image of black as a representative example of the toner image forming units 1Y, 1M, 1C, and 1K. The toner image forming units 1Y, 1M, 1C, and 1K are replaced upon reaching their product life cycles. With reference to FIG. 2, a description is provided of the toner image forming unit 1K as an example of the toner image forming units. FIG. 2 is a schematic diagram illustrating the toner image forming unit 1K. The toner image forming unit 1K includes a drum-shaped photoconductor 2K as an image bearer that bears a latent image. The photoconductor 2K is surrounded by various pieces of imaging equipment, such as a charging device 6K, a developing device 8K, a photoconductor cleaner 3K, and a charge remover. Such devices are held by a common holder so as to be attachable to and detachable from an apparatus body of the image forming apparatus 1000, thus allowing simultaneous replacement.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. For the image forming apparatus 1000 according to the first embodiment, the photoconductor 2K is uniformly charged negatively, which is the same polarity as a normal charge polarity of toner. As a charging bias, an alternating current (AC) voltage superimposed on a direct current (DC) voltage is employed. The charging roller 7K includes a metal cored bar coated with a conductive elastic layer made of a conductive elastic material. According to the first embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image of black, is formed on the photoconductor 2K. As described below, the toner image is transferred primarily onto an intermediate transfer belt 31 in a process known as a primary transfer process.

The photoconductor cleaner 3K removes residual toner remaining on the surface of the photoconductor 2K after the primary transfer process, that is, after the photoconductor 2K passes through a primary transfer nip. The photoconductor cleaner 3K includes a brush roller 4K and a cleaning blade 5K. The cleaning blade 5K is cantilevered, that is, one end of the cleaning blade 5K is secured to a housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K serving as a developer bearer includes a developing portion 12K and a developer conveyor 13K. The developing portion 12K includes a developing roller 9K inside thereof. The developer convener 13K mixes a black developing agent and transports the black developing agent. The developer convener 13K includes a first chamber equipped with a first screw 10K and a second chamber equipped with a second screw 11K. The first screw 10K and the second screw 11K are each constituted of a rotatable shaft and helical blade wrapped around the circumferential surface of the shaft. Each end of the shaft of the first screw 10K and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical flighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density sensor for detecting the density of black toner in black developing agent is disposed at the bottom of a casing of the chamber. As the toner density sensor for black toner, a magnetic permeability detector is employed. There is a correlation between the density of black toner and the magnetic permeability of the black developing agent including toner particles and magnetic carrier particles. Therefore, the magnetic permeability detector can detect the density of black toner.

The image forming apparatus 1000 according to this embodiment includes toner supply devices to supply independently toners of yellow, magenta, cyan, and black to the second chamber of the respective developing devices 8Y, 8M, 8C, and 8K. The controller of the image forming apparatus 1000 includes a Random Access Memory (RAM) to store target output voltages Vtref for output voltages provided by the toner density sensors for yellow, magenta, cyan, and black. If the difference between the output voltages provided by the toner density sensors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the respective developing device 8.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe which is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A non-developing potential acts between the developing sleeve and the non-image formation areas of the photoconductor 2K, causing the toner on the developing sleeve to move to the sleeve surface. Due to the developing potential and the non-developing potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M, and 1C, respectively. The optical writing unit 80 for writing latent images on the photoconductors 2 is disposed above the toner image forming units 1Y, 1M, 1C, and 1K. Based on image information provided by an external device such as a personal computer (PC), the optical writing unit 80 illuminates the photoconductors 2Y, 2M, 2C, and 2K with the laser light projected from a laser diode of the optical writing unit 80. Accordingly, the electrostatic latent images of yellow, magenta, cyan, and black are formed on the photoconductors 2Y, 2M, 2C, and 2K, respectively. The optical writing unit 80 includes a polygon mirror, a plurality of optical lenses, and mirrors. The light beam emitted from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 1, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The primary transfer rollers 35Y, 35M, 35C, and 35K are disposed opposite to the photoconductors 2Y, 2M, 2C, and 2K, respectively, via the intermediate transfer belt 31.

The secondary-transfer first roller 33 is disposed inside the looped intermediate transfer belt 31 and contacts the back surface of the intermediate transfer belt 31 which is an opposite surface to the front surface. The transfer unit 30 also includes a belt cleaning device 37 and a density sensor 40. The intermediate transfer belt 31 is entrained around and stretched taut between the plurality of rollers, i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the primary transfer electrical field and the nip pressure. The intermediate transfer belt 31, on which the yellow toner image has been transferred, passes through the primary transfer nips of magenta, cyan, and black. Subsequently, the toner images on the photoconductors 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to this embodiment, a roller-type transfer device (here, the primary transfer rollers 35) is used as a primary transfer device. Alternatively, a transfer charger or a transfer brush may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondary transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1. The secondary-transfer second roller 36 contacts, via the sheet conveyor belt 41, a portion of the front surface or the image bearing surface of the intermediate transfer belt 31 looped around the secondary-transfer first roller 33, thereby forming a secondary transfer nip therebetween. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as the nip forming member, thereby forming a secondary transfer nip. The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller side to the secondary-transfer second roller side. Alternatively, instead of the sheet conveyor belt 41, a secondary transfer roller may be employed as the nip forming device to contact directly the intermediate transfer belt 31.

As illustrated in FIG. 1, the sheet cassette 100 storing a sheaf of recording sheets P is disposed below the transfer unit 30. The sheet cassette 100 is equipped with a feed roller 100*a* that contacts the top sheet of the sheaf of recording sheets P. As the feed roller 100*a* is rotated at a predetermined speed, the sheet feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet cassette 100 is interposed between the pair of registration rollers 101. The pair of registration rollers 101 starts to rotate again to feed the recording sheet P to the secondary transfer nip in appropriate timing such that the recording sheet P is aligned with the composite toner image formed on the intermediate transfer belt 31 at the secondary transfer nip. In the secondary transfer nip, the recording sheet P tightly contacts the composite toner image on the intermediate transfer belt 31, and the composite toner image is secondarily transferred onto the recording sheet P by the secondary transfer electric field and the nip pressure applied thereto, thereby forming a full-color toner image on the recording sheet P. The recording sheet P, on which the full-color toner image is formed, passes through the secondary transfer nip and separates from the intermediate transfer belt 31 due to self-stripping. Furthermore, the curvature of a separation roller 42, around which the sheet conveyor belt 41 is looped, enables the recording sheet P to separate from the sheet conveyor belt 41.

According to the present illustrative embodiment, the sheet conveyor belt 41 as the nip forming device contacts the intermediate transfer belt 31 to form the secondary transfer nip. Alternatively, a nip forming roller as the nip forming device may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31. More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density) primarily transferred onto the intermediate transfer belt 31 is measured when the toner image comes to the position opposite to the density sensor 40.

The fixing device 90 is disposed downstream from the secondary transfer nip in the direction of conveyance of the recording sheet P. The fixing device 90 includes a fixing roller 91 and a pressing roller 92. The fixing roller 91 includes a heat source such as a halogen lamp inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus 1000 from the fixing device 90 via a post-fixing delivery path after the fixing process.

According to the first embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K.

Figure 3:
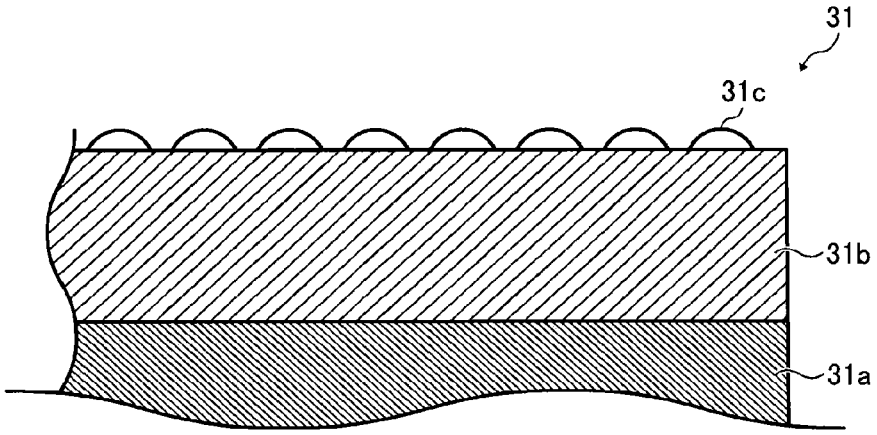
FIG. 3 is a partially enlarged cross-sectional view of an intermediate transfer belt in the image forming apparatus of FIG. 1.
Figure 4:
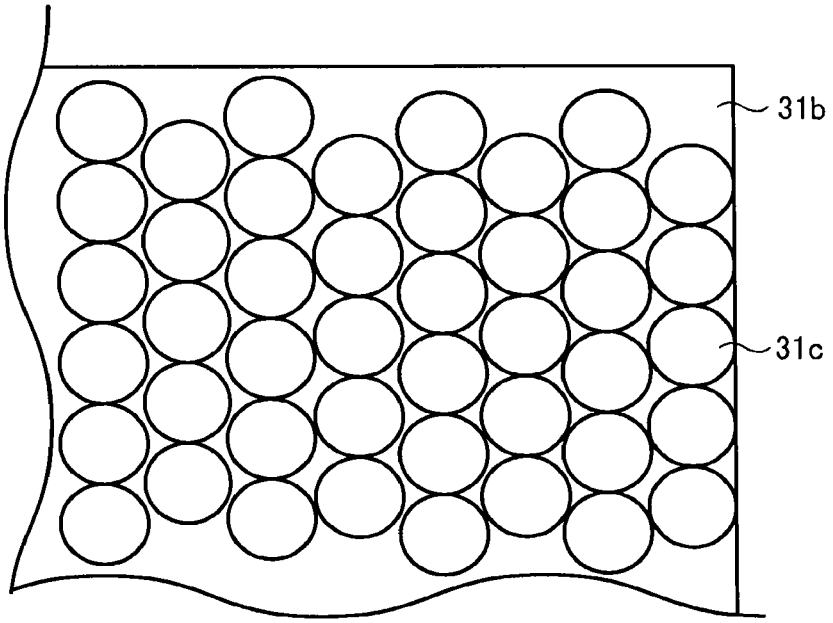
FIG. 4 is a partially enlarged plan view of the intermediate transfer belt.

FIG. 3 is a partially enlarged cross-sectional view schematically illustrating a transverse plane of the intermediate transfer belt 31. As illustrated in FIG. 3, the intermediate transfer belt 31 includes a base layer 31*a* and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, an uneven surface of the belt with multiple bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 31*a*, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt 31) in which the electrical characteristics (i.e., the surface resistivity and the volume resistivity) and the mechanical strength are well balanced. The content of the electrical resistance adjusting material in the coating liquid when using carbon black is in a range from 10% to 25% by weight or preferably, from 15% to 20% by weight relative to the solid content. The content of the electrical resistance adjusting material in the coating liquid when using metal oxides is approximately 150% by weight or more preferably, in a range from 10% to 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base layer 31*a* having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 includes an uneven surface formed with the particles 31*c* dispersed in the elastic layer 31*b*. Examples of elastic materials for the elastic layer 31*b* include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, acrylic rubbers, chlorosulfonated polyethylenes, fluorocarbon rubbers, urethane rubbers, and hydrin rubbers. A material having desired characteristics can be selected from the above-described materials. In particular, in order to accommodate a recording sheet with a rough surface, such as Leathac (registered trademark), soft materials are preferable. Note that the term "rough" used herein also includes meanings of not only rough but, for example, irregular, textured, embossed, and uneven. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 31*b*. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1, 3, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. to 220° C., more preferably, 140° C. to 200° C. The crosslinking time period is preferably in a range of 30 seconds to 5 hours. The heating methods can be chosen from those which are conventionally used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 to 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is, preferably, in a range from $1\times10^{8}$ Ω/sq to $1\times10^{13}$ Ω/sq, and the volume resistivity of the elastic layer 31*b* is, preferably, in a range from $1\times10^{6}$ Ω·cm to $1\times10^{12}$ Ω·cm. In order to obtain high toner transferability relative to a rough surface of a recording sheet as is desired in image forming apparatuses using electrophotography in recent years, it is preferable to adjust a micro rubber hardness of the elastic layer 31*b* to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the rough surface of the recording sheet, thereby impairing the desired transferability relative to the rough surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 31*b* is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, releasability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ±(Average particle diameter×0.5 μm). With the particle diameter of the particle 31*c* less than 1.0 μm, enhancement of transfer performance by the particle 31*c* cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 31*c* made of resin material has a relatively high insulation property. Thus, if the particle diameter is too large, accumulation of electrical charges of the particle diameter 31*c* during continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely. Preferably, the cross-sectional diameter of the plurality of particles 31*c* in the surface direction of the elastic layer 31*b* is as uniform as possible. More specifically, the distribution width thereof is equal to or less than ±(Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use particles having a relatively large particle diameter distribution. It is to be noted that timing at which the particles 31*c* are applied to the surface of the elastic layer 31*b* is not particularly limited. The particles 31*c* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31.

Figure 5:
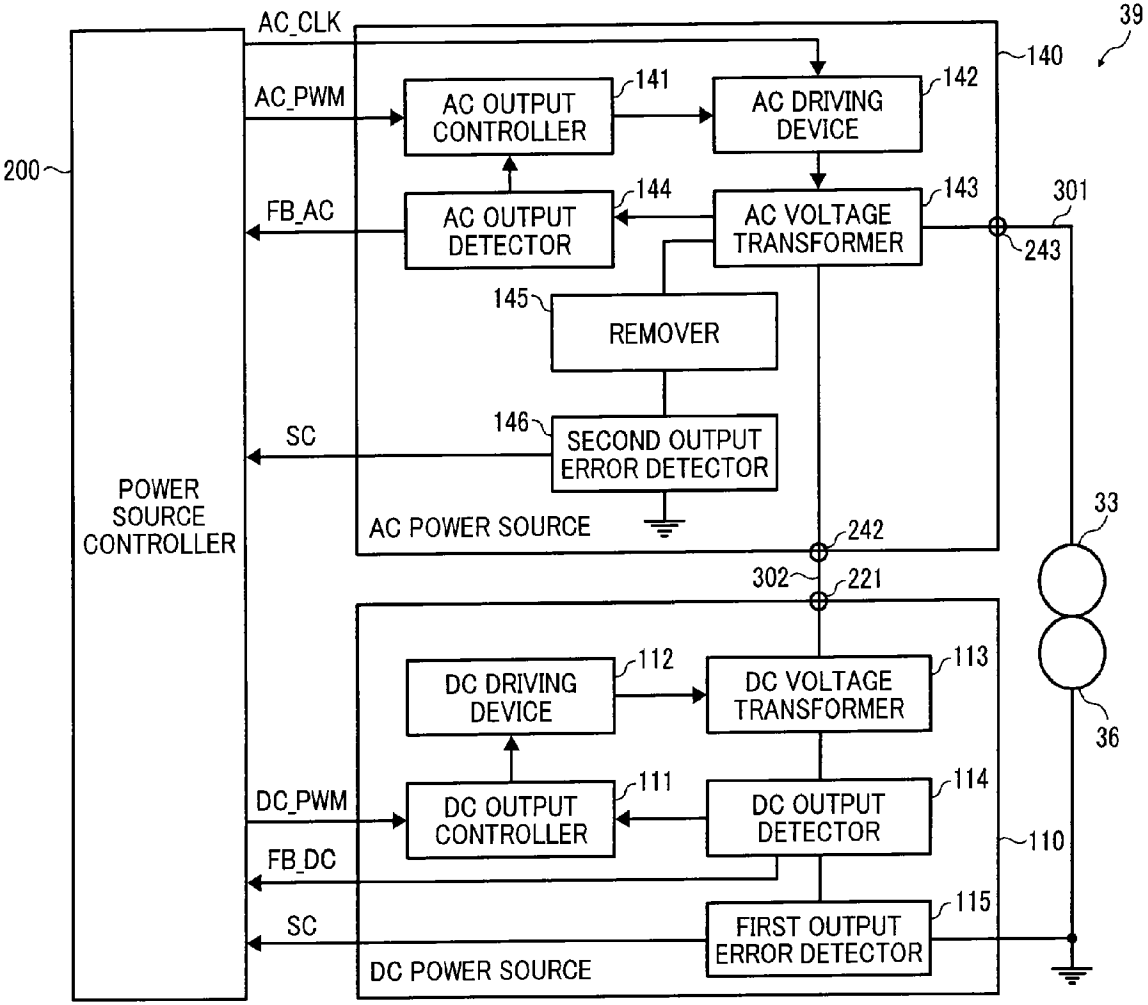
FIG. 5 is a block diagram of a portion of an electrical circuit of a secondary transfer power source, a secondary-transfer first roller, and a secondary-transfer second roller in the image forming apparatus of FIG. 1.

FIG. 5 is a block diagram of a portion of an electrical circuit of a secondary transfer power source, the secondary-transfer first roller 33, and the secondary-transfer second roller 36 in the image forming apparatus 1000 of FIG. 1. As illustrated in FIG. 5, the secondary transfer power source 39 includes a direct-current (DC) power source 110 and an alternating current (AC) power source 140, a power source controller 200, and so forth. The AC power source 140 is detachably mountable relative to a maim body of the secondary transfer power source 39. The DC power source 110 outputs a DC voltage to apply an electrostatic force to toner on the intermediate transfer belt 31 so that the toner moves from the belt side to the recording sheet side in the secondary transfer nip. The DC power source 110 includes a DC output controller 111, a DC driving device 112, a DC voltage transformer 113, a DC output detector 114, a first output error detector 115, an electrical connector 221, and so forth.

The AC power source 140 outputs an alternating current voltage to be superimposed with the direct current voltage. The AC power source 140 includes an AC output controller 141, an AC driving device 142, an AC voltage transformer 143, an AC output detector 144, a remover 145, a second output error detector 146, electrical connectors 242 and 243, and so forth.

The power source controller 200 controls the DC power source 110 and the AC power source 140, and is equipped with a central processing unit (CPU), a Read Only Memory (ROM), a Random Access Memory (RAM), and so forth. The power source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 200 to control the duty of the DC_PWM signal in the power source controller 200 so as not to impair transferability due to environment and load. According to the present illustrative embodiment, the AC power source 140 is detachably mountable relative to the main body of the secondary transfer power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present illustrative embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present illustrative embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the power source controller 200 can stop the DC power source 110 to output the high voltage.

The power source controller 200 inputs an AC_PWM signal and an output value of the AC voltage transformer 143 detected by the AC output detector 144. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) provided to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power source controller 200 to control the duty of the AC_PWM signal in the power source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present illustrative embodiment, the waveform of the AC voltage is a short-pulse square wave. The AC voltage having a short-pulse square wave can enhance image quality.

Figure 6:
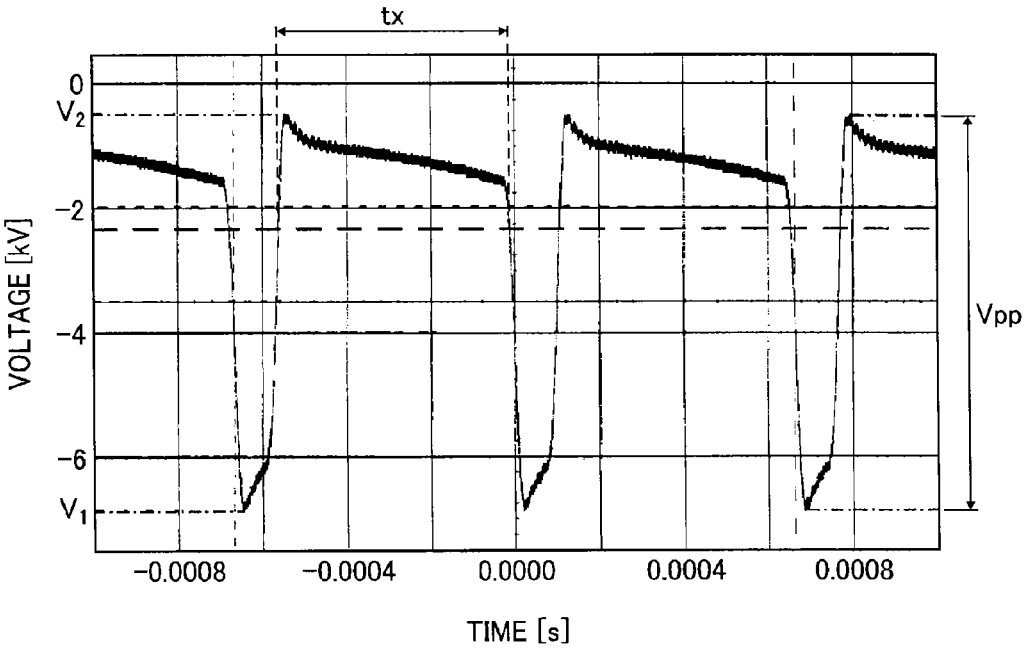
FIG. 6 is a graph of characteristics of a secondary transfer bias that is employed in a second test print.

In the image forming apparatus 1000 according to the first embodiment, toner containing carbon black is used as black toner. In addition, in a color print mode in which not only a black toner image but also toner images of other colors are formed, a secondary transfer bias having characteristics illustrated in FIG. 6 is applied to the secondary-transfer first roller 33 as a transfer bias member. In the image forming apparatus 1000, the secondary transfer bias is applied to the secondary-transfer first roller 33 that is located inside a loop of the intermediate transfer belt 31. In the above-described configuration, when the secondary transfer bias is set to a value of a negative polarity that is the same polarity as that of toner, the toner is electrostatically moved from a belt side to a recording sheet side at the inside of the secondary transfer nip. In contrast, an image forming apparatus differing from the image forming apparatus 1000 according to the first embodiment may have a configuration in which the secondary transfer bias is applied to the secondary-transfer second roller 36 at the outside of the loop of the intermediate transfer belt 31. In such a configuration, when the secondary transfer bias is set to a value of a positive polarity that is opposite to the polarity of toner, the toner is electrostatically moved from the belt side to the recording sheet side in the secondary transfer nip.

In FIG. 6, Vpp is a peak-to-peak value of an alternating current component of a secondary transfer bias composed of a superimposed bias. In addition, a first peak value $V_1$ is a first peak value, which further increases an electrostatic force that moves toner from the intermediate transfer belt 31 side toward the recording sheet side in the secondary transfer nip, between the first peak value and a second peak value in a peak-to-peak of the secondary transfer bias. In addition, a second peak value $V_2$ is the second peak value, which further increases the electrostatic force that moves toner from the intermediate transfer belt 31 side toward the recording sheet side in the secondary transfer nip, between the first peak value and the second peak value of the secondary transfer bias. In a color print mode, as illustrated in FIG. 6, a secondary transfer bias, which has a negative polarity exhibiting an electrostatic force in a transfer direction which moves toner from the belt side to the recording sheet side in the secondary transfer nip, is applied in combination of the first peak value $V_1$ and the second peak value $V_2$. The value of the first peak value $V_1$ is, for example, −7.0 kV, and the value of the second peak value $V_2$ is, for example, −0.6 kV. In the configuration, in comparison to a configuration in which a secondary transfer bias composed of only a direct current bias of −7.0 kV is applied, it is possible to further reduce the amount of charges of the opposite polarity (in this example, positive charges) which are injected to toner in the secondary transfer nip, and thus it is possible to suppress occurrence of secondary transfer failure of a toner image. The above-described configuration is a basic configuration of the image forming apparatus 1000 according to the first embodiment.

Below, a further description is provided of a configuration of the image forming apparatus 1000 according to the first embodiment of the present disclosure. The inventors of the present application prepared a test printer (a test image forming apparatus) having a configuration in which a bias having characteristics illustrated in FIG. 6 is applied to the secondary-transfer first roller 33 as the secondary transfer bias. A power source controller 200 of the test printer allows a secondary transfer power source, which includes an AC power source 140, a DC power source 110, and the like, to output a secondary transfer bias having the following characteristics.

Peak-to-peak value Vpp: 6.4 kV
First peak value $V_1$: −7.0 kV
Second peak value $V_2$: −0.6 kV
Direct current bias (offset voltage Voff): −3.8 kV
Average potential Vave: −2.0 kV
Cycle of alternating current component: 0.66 ms
Duration tx of inhibition side potential: 0.56 ms
Duty: 85%

Furthermore, a base line is a line that extends in a time axis direction at a position corresponding to a value obtained by shifting the second peak value $V_2$ to a first peak value $V_1$ side by a potential of 30% in a peak-to-peak value of an alternating current component. For example, in FIG. 6, a line, which extends in a time axis direction at a position of −2.52 kV, is the base line.

In addition, the duty is a characteristic value to be described below. That is, typically, a waveform of a secondary transfer bias composed of a superimposed bias does not become a clear rectangular wave. Accordingly, a little time (not zero) is necessary until a potential rises from one peak value (for example, the second peak value $V_2$) to the other peak value (for example, the first peak value $V_1$), or the potential rises from the other peak value to the one peak value. In a waveform of the secondary transfer bias as described above, a peak value, which further inhibits electrostatic movement of toner from the belt side to the recording sheet side in the secondary transfer nip, between one peak value and the other peak value in a peak-to-peak is defined as an inhibition peak value. In the first embodiment, the second peak value $V_2$ is the inhibition peak value. As described above, a position, which corresponds to a value obtained by shifting the inhibition peak value toward the other peak value by 30% of a peak-to-peak value, is the base line of the waveform. In addition, a duration tx of the inhibition side potential is time at which a potential becomes a value of the inhibition peak value side in relation to the base line. A proportion of the duration tx of the inhibition side potential in one cycle of a waveform is the duty.

First Test Print

A test print was carried out by using the test printer having the above-described configuration. Specifically, as operation conditions of the test printer, a process linear velocity (a linear velocity of the photoconductor or the intermediate transfer belt) was set to 630 mm/s, and a width of the secondary transfer nip (nip length in a belt travel direction) was set to 4 mm. In addition, a solid black image was printed under an environment of a temperature of 23° C. and humidity of 50% by using "OK Special Art, 279 gsm (SRA3)" as the recording sheet. In addition, a solid yellow image, a solid magenta image, and a solid cyan image were respectively printed on sheets of paper which are different from each other. At this time, during a print job, the job is temporarily stopped, and a toner adhesion amount on a belt immediately before entering the secondary transfer nip was measured. Results were as follows. Yellow toner adhesion amount: 0.38 mg/cm$^2$ Magenta toner adhesion amount: 0.41 mg/cm$^2$ Cyan toner adhesion amount: 0.36 mg/cm$^2$ Black toner adhesion amount: 0.38 mg/cm$^2$.

Second Test Print

A solid black image was printed under the same conditions as in the first test print. In addition, a solid blue image, which is obtained by overlapping of the solid cyan image and the solid magenta image, was printed on a sheet different from the sheet for the solid black image. In addition, the grade of transferability of the solid images on the sheet was visually evaluated. Specifically, Grade 5 indicates that a sufficient image density was obtained on the sheet. Grade 4 indicates that the density was slightly lower than that of Grade 5 and is in a permissible range. Grade 3 indicates that the density was further lower than that of Grade 4 and become a lower image density beyond a permissible range of image quality provided to a user. Grade 2 indicates that the density was lower than that of Grade 3. Grade 1 indicates that the test image looked generally white or even whiter (less density). The acceptable image quality to satisfy users was Grade 4 or above.

As a result, the solid blue image on the sheet was evaluated as Grade 5, and the solid black image on a separate sheet was evaluated as Grade 3. The black toner adhesion amount is sufficient on the intermediate transfer belt 31 immediately entering the secondary transfer nip, and thus the image density on the sheet becomes deficient in the solid black image due to secondary transfer failure.

As described above, the inventors of the present application have made a thorough investigation with respect to the cause for occurrence of the secondary transfer failure in a case where only the solid black image is secondary-transferred onto a sheet (recording sheet), and as a result, they obtained the following finding. Specifically, a charge amount Q/M μC/g of a toner on the intermediate transfer belt 31 immediately before entering the secondary transfer nip considerably decreases only in the black toner.

Figure 7:
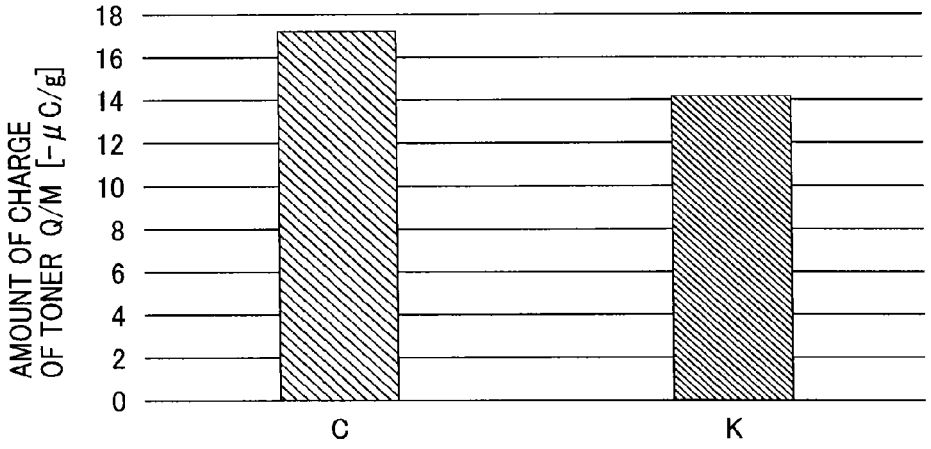
FIG. 7 is a graph of a relationship between a toner charge amount and a toner color in a toner image on the intermediate transfer belt immediately before entering a secondary transfer nip.

FIG. 7 is a graph illustrating a relationship between a toner charge amount and a toner color in a toner image on the intermediate transfer belt 31 immediately before entering the secondary transfer nip. As illustrated in FIG. 7, the charge amount Q/M of the black toner in the solid black image becomes smaller than the charge amount Q/M of the cyan toner in the solid cyan image. Although not illustrated in FIG. 7, the charge amount Q/M of the magenta toner in the solid magenta image becomes slightly greater than the charge amount Q/M of the cyan toner, and the charge amount Q/M of the yellow toner in the solid yellow image becomes the same as that of the magenta toner or becomes slightly greater than that of the magenta toner.

The inventors of the present application found that two main reasons exit as the reason why the charge amount Q/M of the black toner becomes smaller than the charge amount Q/M of toner of other colors. The first reason is as follows. Among the yellow toner image, the cyan toner image, the magenta toner image, and the black toner image, only the black toner image, which is finally subjected to a primary transfer process, does not pass through primary transfer nips for other colors, and thus charge-up does not occur during passing through the primary transfer nips for other colors. All of the yellow toner image, the magenta toner image, and the cyan toner image are charged up during passing through the primary transfer nips for other colors. The reason why the charge amount of the yellow toner in the yellow toner image becomes the greatest among toner images of other colors is that the amount of charge-up at the primary transfer nips for other colors (the number of times of passing) becomes the greatest. Hereinafter, a phenomenon, in which the charge amount Q/M becomes smaller than that of toner of other colors when not being subjected to transfer processes for other colors and not being charged-up, is referred to as "low charge amount caused by without charge-up".

Figure 9:
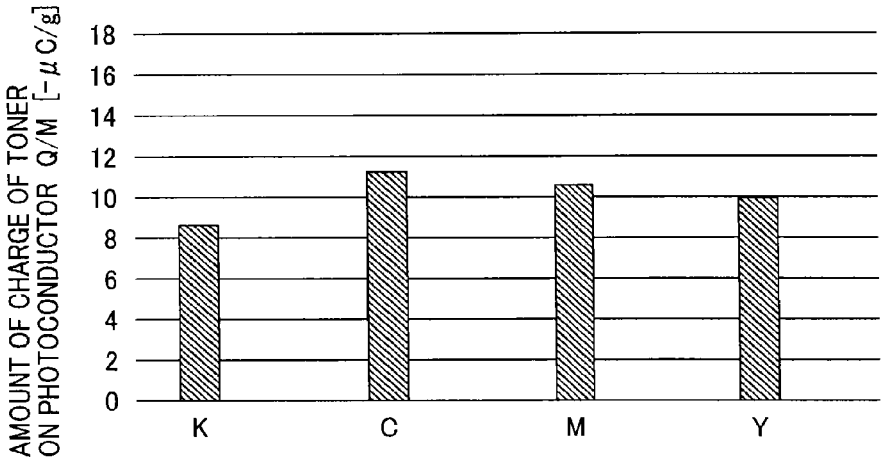
FIG. 9 is a graph of a charge amount Q/M of a toner image of each color on a surface of a photoconductor 2 before entering a primary transfer nip.

The second reason is as follows. Among the yellow toner, the magenta toner, the cyan toner, and the black toner, only the black toner contains carbon black, and thus the black toner is not likely to be frictionally charged. FIG. 9 is a graph illustrating the charge amount Q/M of a toner image of each color on a surface of a photoconductor 2 before entering a primary transfer nip. In toner of which the charge amount Q/M is illustrated in FIG. 9, since all colors represent colors at time before entering the primary transfer nip, and thus charge-up due to passing-through of primary transfer nips for multi-colors does not occur. As illustrated in FIG. 9, even before the charge-up occurs, the charge amount Q/M of the black toner becomes the smallest among respective colors of toner. The reason for this is that only the black toner contains carbon. Hereinafter, a phenomenon, in which the charge amount becomes relatively small when containing carbon, is referred to as "low charge amount caused by carbon".

Third Test Print

Figure 8:
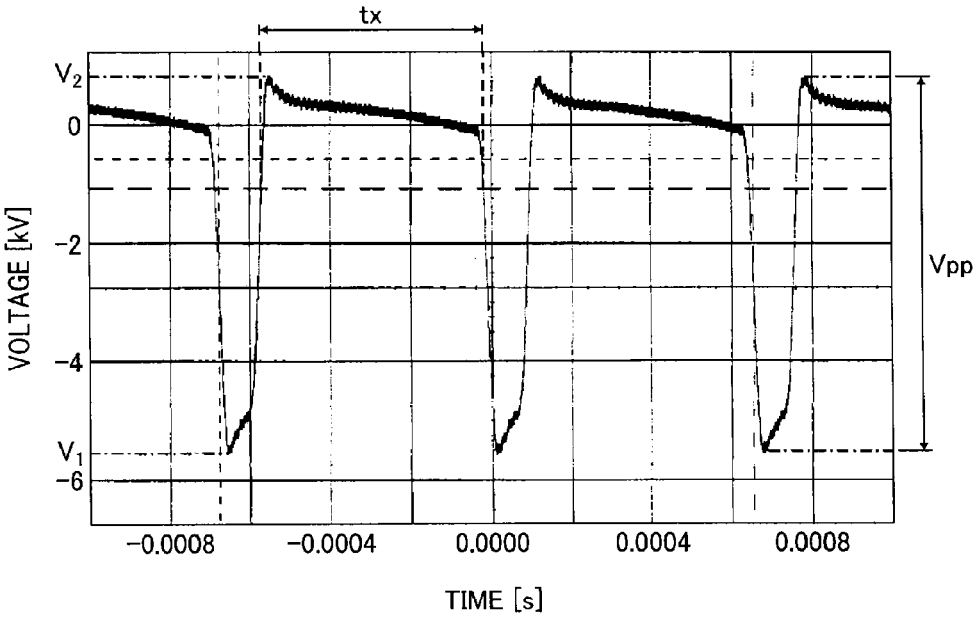
FIG. 8 is a graph of characteristics of a secondary transfer bias that is employed in a third test print.

A solid black image is printed on a sheet under the same conditions as in the second test print except that characteristics of the secondary transfer bias are changed. FIG. 8 is a graph illustrating characteristic of the secondary transfer bias that is employed in the third test print. Details of the characteristics of the secondary transfer bias are as follows.

Peak-to-peak value Vpp: 6.4 kV
First peak value $V_1$: −5.5 kV
Second peak value $V_2$: 0.9 kV
Direct current bias (offset voltage Voff): −2.3 kV
Average potential Vave: −0.5 kV
Cycle of alternating current component: 0.66 ms
Duration tx of inhibition side potential: 0.56 ms
Duty: 85%

A difference from the secondary transfer bias illustrated in FIG. 6 is that the absolute value of the direct current bias is made to be smaller to make the absolute value of the first peak value $V_1$ smaller, and the polarity of the second peak value $V_2$ is set to be positive. From visual evaluation of the grade of the transferability of the solid black image printed on a sheet under the characteristic conditions of the secondary transfer bias, a result of Grade 5 was obtained, and this result obtained was very satisfactory. As described above, the reason why secondary transferability of the solid black image could be further improved in comparison to the second test print is as follows. That is, the polarity of the second peak value $V_2$ was set to be positive to make the absolute value of the average potential Vave of the secondary transfer bias be smaller. Accordingly, the amount of charges of the opposite polarity which were injected to the black toner in the secondary transfer nip was reduced. As a result, secondary transfer failure caused by the injection of the charges of the opposite polarity could be suppressed. Specifically, in a monochromatic mode, superimposition of the yellow toner, the magenta toner, and the cyan toner does not occur, and thus the amount of toner that enters the secondary transfer nip becomes smaller in comparison to a full-color mode. In the monochromatic mode, when employing the same secondary transfer bias as in the full-color mode, the injection amount of the charges of the opposite polarity per one toner particle inside the secondary transfer nip further increases in comparison to the full-color mode. Therefore, the toner charge amount at a normal polarity is likely to significantly decrease, or toner is likely to be reversely charged, and thus deficiency in an image density due to the secondary transfer failure is likely to occur.

Here, in the image forming apparatus 1000 according to the first embodiment, the power source controller 200 is configured to control the secondary transfer bias as follows. Specifically, in a case where a color toner image including black toner and at least one of yellow toner, magenta toner, and cyan toner is secondary-transferred to the recording sheet, a secondary transfer bias, in which the second peak value $V_2$ has a negative polarity that moves toner in a transfer direction, or zero, is output. That is, in a color print mode (for example, a full-color mode using yellow toner, magenta toner, cyan toner, and black toner), a secondary transfer bias, in which the second peak value $V_2$ has a negative polarity that moves toner in the transfer direction, or zero, is output. In contrast, in the case of transferring a monochromatic image including only the black toner to the recording sheet, a secondary transfer bias, in which the second peak value $V_2$ is zero or has a positive polarity that moves toner in a direction opposite to the transfer direction, is output. That is, in a monochromatic print mode using only the black toner, a secondary transfer bias, in which the second peak value $V_2$ is zero or has a positive polarity that moves toner in a direction opposite to the transfer direction, is output.

More specifically, in the case of the full-color mode, a secondary transfer bias, in which the second peak value $V_2$ has a negative polarity that moves toner in the transfer direction or is zero, is output. In contrast, in the case of the monochromatic mode, a secondary transfer bias, in which the second peak value $V_2$ is zero or has a positive polarity that moves toner in a direction opposite to the transfer direction, is output.

In the above-described configuration, as is verified in the third test print, it is possible to suppress occurrence of transfer failure in the case of secondary-transferring only the black toner image, in which the toner charge amount at a normal polarity becomes the smallest among toner images of respective colors, to the recording sheet.

Furthermore, as is clear from comparison between FIG. 6 and FIG. 8, it is necessary to control the first peak value $V_1$ as follows. That is, in the monochromatic print mode, it is necessary to set an electrostatic force in the transfer direction to a smaller value in comparison to the color print mode. As more detail conditions, in a graph waveform illustrating a relationship between a voltage and time, with regard to an area on a negative polarity side that exhibits an electrostatic force in the transfer direction, it is necessary to make an area in the monochromatic print mode smaller than an area in the color print mode.

In a technical idea, characteristics of the secondary transfer bias are set to be different depending on an image area rate of an output image, and the characteristics of the secondary transfer bias are changed depending on the amount of toner that enters the secondary transfer nip. However, the present disclosure is not based on the technical idea in which the characteristics of the secondary transfer bias are changed depending on the amount of toner. As is clear from a graph in FIG. 7, even when the amount of toner that enters the secondary transfer nip is the same in each case, secondary transferability is different between the cyan toner image and the black toner image due to a difference in the charge amount Q/M, and thus the secondary transfer failure of the black toner image occurs in a secondary transfer bias having the same characteristics. The technical idea of the present disclosure is to suppress occurrence of the transfer failure due to the "low charge amount caused by carbon" or the "low charge amount caused by without charge-up".

In addition, in specifications in which the "low charge amount caused by carbon" more significantly occurs in comparison to "low charge amount caused by without charge-up", even in a case where a primary transfer process of the black toner image is not set to a final process, the secondary transfer failure may occur only in the black toner image among respective colors. For example, it is assumed that a toner image forming unit 1K for black is disposed at a position on a most upstream side of respective colors, and the black toner image, which is primary-transferred to the intermediate transfer belt 31, is allowed to sequentially pass through the primary transfer nips for yellow, magenta, and cyan. Even in the configuration, the charge amount Q/M of the black toner immediately before entering the secondary transfer nip may become the smallest among respective colors. Even in this case, as is the case with the image forming apparatus 1000 according to the first embodiment, when the characteristics of the secondary transfer bias are made to be different between the monochromatic print mode and the color print mode, it is possible to suppress occurrence of the secondary transfer failure of the black toner image in the monochromatic mode.

The secondary transfer bias that is output from the secondary transfer power source 39 may be controlled in accordance with a mode as follows. That is, when secondary-transferring a monochromatic toner image including only the black toner (in a monochromatic mode), the secondary transfer bias is set to a value that is suitable for secondary transfer of the black toner. Specifically, as illustrated in the graph of FIG. 8, a secondary transfer bias, in which the second peak value $V_2$ is zero or has a positive polarity that moves toner in a direction opposite to the transfer direction, is output. On the other hand, when secondary-transferring a color toner image including the black toner and non-black toner other than the black toner (for example, in the full-color mode using yellow toner, magenta toner, cyan toner, and black toner), the secondary transfer bias may be controlled as follows. That is, the secondary transfer bias is set to a value capable of realizing compatibility between secondary transferability of the yellow toner, the magenta toner, and the cyan toner in which the charge amount is relatively great, and secondary transferability of the black toner in which the charge amount is relatively small. More specifically, as illustrated in the graph in FIG. 6, a secondary transfer bias, in which the second peak value $V_2$ has a negative polarity that moves toner in the transfer direction or is zero, is output.

According to the first embodiment, as the intermediate transfer belt 31, a belt with an upper most layer (i.e., the elastic layer 31*b*) in which particles (the particles 31*c*) are dispersed is used. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 31*c* which are arranged regularly, the electrical charges having an opposite polarity get injected easily to the toner. As a result, even when the particles 31*c* are dispersed to enhance the transfer rate, the secondary transfer rate may decrease. Hence, in the monochromatic mode, a secondary transfer bias having characteristics illustrated in FIG. 8, instead of the characteristics illustrated in FIG. 6, is output, thus reliably suppressing the occurrence of a secondary transfer failure in a black toner image due to the injection of opposite electrical charges to toner.

As the particles 31*c*, for example, particles having a charge property of the opposite charge polarity to the normal charge polarity of the toner. According to the first embodiment, the particles 31*c* are constituted of melamine resin particles having a positive charging property. With this configuration, electrical charges of the particles 31*c* suppress concentration of the secondary transfer current between the particles, hence further reducing the injection of opposite electrical charges to the toner.

Alternatively, in some embodiments, particles having a charge property of the same charge polarity as the normal charge polarity of the toner are used as the particles 31*c*. For example, silicone resin particles having a negative charge property (i.e., Tospearl (trade name)) can be used.

In some embodiments, the intermediate transfer belt 31 may include an uppermost layer made of urethane or Teflon (registered trademark). Alternatively, the intermediate transfer belt 31 may include multiple layers made of resins such as polyimide and polyamide-imide. With either belts, using the secondary transfer bias with a high duty can prevent inadequate image density.

Furthermore, in the full-color print mode, typically, a toner adhesion amount per unit area with respect to the recording sheet increases. Therefore, even in the full-color mode, when employing a secondary transfer bias having characteristics illustrated in FIG. 8, transfer failure is likely to occur.

In addition, typically, as illustrated in FIG. 8, a secondary transfer bias, in which the first peak value $V_1$ and the second peak value $V_2$ are set to have polarities which are opposite to each other, is employed as the secondary transfer bias regardless of the print mode. However, in the image forming apparatus 1000 according to the first embodiment, as illustrated in FIG. 6, a secondary transfer bias, in which the two peak values are set to have the same polarity, is employed in the color print mode. When the polarity is not reversed, it is possible to suppress degradation in accordance with electric discharge at the intermediate transfer belt 31, the secondary-transfer first roller 33, and the like.

Next, description will be given of an image forming apparatus of Variation 1-1 in which the configuration of a part of the image forming apparatus according to the first embodiment is modified into a different configuration. Furthermore, the configuration of the image forming apparatus according to Variation 1-1 is the same as in the first embodiment unless otherwise stated.

In the image forming apparatus according to Variation 1-1, toner, which does not contain carbon black, is used as the black toner. Accordingly, the "low charge amount caused by carbon" does not occur. In addition, the toner image forming unit 1K for black is disposed at a position on a most upstream side, and the toner image forming unit 1C for cyan is disposed at a position on a most downstream side. That is, the cyan toner image (a most downstream-side toner image), which is secondary-transferred to the intermediate transfer belt 31, does not pass through primary transfer nips for other colors, and thus the "low charge amount caused by without charge-up" occurs. In addition, among respective colors of toner immediately before entering the secondary transfer nip, the charge amount Q/M of the cyan toner becomes the smallest.

Here, in the image forming apparatus according to Variation 1-1, the power source controller 200 is configured to control the secondary transfer bias as follows. That is, in a case where the black toner image, which is carried on the photoconductor 2K for black as a most upstream-side image bearer, is secondary-transferred to the recording sheet, a secondary transfer bias, in which the second peak value $V_2$ has a negative polarity that moves toner in the transfer direction or is zero, is output. In contrast, in the case of secondary-transferring only the cyan toner image, which is carried on the photoconductor 2C for cyan as a most downstream-side image bearer, to the recording sheet, a secondary transfer bias, in which the second peak value $V_2$ is zero or has a positive polarity that moves toner in a direction opposite to the transfer direction, is output. More specifically, in the case of secondary-transferring the black toner image to the recording sheet, a secondary transfer bias having characteristics illustrated in the graph of FIG. 6 is output. On the other hand, in the case of secondary-transferring only the cyan toner image to the recording sheet, a secondary transfer bias having characteristics illustrated in the graph of FIG. 8 is output. In the above-described configuration, it is possible to suppress the secondary transfer failure of the cyan toner image when secondary-transferring only the cyan toner image to the recording sheet.

The secondary transfer bias, which is output from the secondary transfer power source 39, may be controlled in accordance with a mode as follows. That is, when secondary-transferring only the cyan toner image which is carried on the photoconductor 2C for cyan as the most downstream-side image bearer (in a first mode), the secondary transfer bias is set to a value suitable for secondary transfer of the cyan toner. Specifically, as illustrated in the graph of FIG. 8, a secondary transfer bias, in which the second peak value $V_2$ is zero or has a positive polarity that moves toner in a direction opposite to the transfer direction, is output. On the other hand, when secondary-transferring toner images including toner other than the cyan toner (for example, in a second mode using the yellow toner, the magenta toner, the cyan toner, and the black toner), the secondary transfer bias is controlled as follows. That is, the secondary transfer bias is set to a value capable of realizing compatibility between secondary transferability of the yellow toner, the magenta toner, and the black toner in which the charge amount is relatively great, and secondary transferability of the cyan toner in which the charge amount is relatively small. Specifically, as illustrated in the graph of FIG. 6, a secondary transfer bias, in which the second peak value $V_2$ has a negative polarity that moves toner in the transfer direction or is zero, is output.

Furthermore, in the image forming apparatus according to Variation 1-1, the black toner image is a most upstream-side toner image. In addition, it is necessary to control the first peak value $V_1$ as follows. That is, in the case of secondary-transferring the black toner image, it is necessary to set an electrostatic force in the transfer direction to a smaller value in comparison to the case of secondary-transferring only the cyan toner image. As more detail conditions, in a graph waveform illustrating a relationship between a voltage and time, with regard to an area on a negative polarity side that exhibits an electrostatic force in the transfer direction, it is necessary to make an area in the case of secondary-transferring only the cyan toner image smaller than an area in the case of secondary-transferring the black toner image.

Next, description will be given of an image forming apparatus according to Variation 1-2. The configuration of the image forming apparatus according to Variation 1-2 is the same as in the first embodiment unless otherwise stated.

Even in the image forming apparatus according to Variation 1-2, toner, which does not contains carbon black, is used as the black toner, and thus the "low charge amount caused by carbon" does not occur. As is the case with the first embodiment, the toner image forming units for respective colors are arranged in the order of yellow, magenta, cyan, and black, and black is disposed on a most downstream side. The charge amount Q/M of the cyan toner in the cyan toner image becomes the smallest among toner images, which are individually secondary-transferred to the intermediate transfer belt 31, due to characteristics of the respective colors of toner or arrangement positions thereof.

Here, in the image forming apparatus according to Variation 1-2, the power source controller 200 is configured to control the secondary transfer bias as follows. That is, in the case of secondary-transferring the yellow toner image, which is a maximum-charge-amount toner image in which the toner charge amount Q/M immediately before being secondary-transferred to the recording sheet becomes the largest among toner images of respective colors, to the recording sheet, as the secondary transfer bias, a secondary transfer bias having the following characteristics is output. Specifically, the secondary transfer bias has characteristics in which the second peak value $V_2$ has a negative polarity that moves toner in the transfer direction or is zero. In contrast, in the case of secondary-transferring only the cyan toner image, which is a minimum-charge-amount toner image in which the toner charge amount Q/M immediately before being secondary-transferred to the recording sheet becomes the smallest, to the recording sheet, as the secondary transfer bias, a secondary transfer bias having the following characteristics is output. Specifically, the secondary transfer bias has characteristics in which the second peak value $V_2$ is zero or has a positive polarity that moves toner in a direction opposite to the transfer direction. More specifically, in the case of secondary-transferring the yellow toner image to the recording sheet, a secondary transfer bias having characteristics illustrated in the graph of FIG. 6 is output. On the other hand, in the case of secondary-transferring only the cyan toner image to the recording sheet, a secondary transfer bias having characteristics illustrated in the graph of FIG. 8 is output. In the above-described configuration, it is possible to suppress the secondary transfer failure of the cyan toner image when secondary-transferring only the cyan toner image to the recording sheet.

The secondary transfer bias, which is output from the secondary transfer power source 39, may be controlled in accordance with a mode as follows. That is, in the case of secondary-transferring only the cyan toner image which is the smallest-charge-amount toner image in which the toner charge amount Q/M of immediately before being secondary-transferred to the recording sheet becomes the smallest (in the first mode), the secondary transfer bias is set to a value suitable for the secondary transferability of the cyan toner. Specifically, as illustrated in the graph of FIG. 8, a secondary transfer bias, in which the second peak value $V_2$ is zero or has a positive polarity that moves toner in a direction opposite to the transfer direction, is output. On the other hand, when secondary transferring a toner image including toner other than the cyan toner (for example, in the second mode using the yellow toner, the magenta toner, the cyan toner, and the black toner), the secondary transfer bias is set to a value capable of realizing compatibility between secondary transferability of the yellow toner, the magenta toner, and the black toner in which the charge amount is relatively great, and secondary transferability of the cyan toner in which the charge amount is relatively small. Specifically, as illustrated in the graph of FIG. 6, a secondary transfer bias, in which the second peak value $V_2$ has a negative polarity that moves toner in the transfer direction or is zero, is output.

Furthermore, it is necessary to control the first peak value $V_1$ as follows. That is, in the case of secondary-transferring the yellow toner image, it is necessary to set an electrostatic force in the transfer direction to a smaller value in comparison to the case of secondary-transferring only the cyan toner image. As more detail conditions, in a graph waveform illustrating a relationship between a voltage and time, with regard to an area on a negative polarity side that exhibits an electrostatic force in the transfer direction, it is necessary to make an area in the case of secondary-transferring only the cyan toner image smaller than an area in the case of secondary-transferring the yellow toner image.

The toner charge amount Q/M in a toner image immediately before entering the secondary transfer nip can be measured as follows. Specifically, first, when a solid toner image for measurement of the charge amount is formed, and is transferred onto the intermediate transfer belt 31, the image forming apparatus is stopped before the toner image enters the secondary transfer nip. In addition, toner of the solid toner image on the intermediate transfer belt 31 is sucked with a suck-in nozzle. Before the suction, the weight of an empty suck-in nozzle is measured in advance by an electronic balance (Sartorius RC210S, METTLER TOLEDO AG285). In addition, the weight of the suck-in nozzle after suction is measured by the electronic balance, and the amount of variation in the weight of the nozzle is set as the weight of toner M. The amount of charges C is measured by an electrometer (KEITHLEY 617 or KEITHLEY 6517) under conditions in which a charge measurement range is extended to 0.01 μC to 1000 μC. Then, the toner charge amount Q/M is obtained through calculation.

Next, description will be given of the image forming apparatus according to a second embodiment of the present disclosure. Furthermore, the basic configuration of the image forming apparatus according to the second embodiment is the same as in the image forming apparatus according to the first embodiment, and thus redundant descriptions thereof will be omitted below.

In the image forming apparatus according to the first embodiment, it is assumed that an environment of a chamber, in which the image forming apparatus is placed, does not vary in a state in which a temperature is set to 23° C. and humidity is set to 50% RH, but the environment of the chamber, in which the image forming apparatus is placed, may vary. Here, the inventors of the present application have performed an experiment of investigating a relationship between the charge amount Q/M of toner images of respective colors on a surface the photoconductor 2 immediately before entering the primary transfer nip, and the environment. Results are illustrated in FIG. 10.

Figure 10:
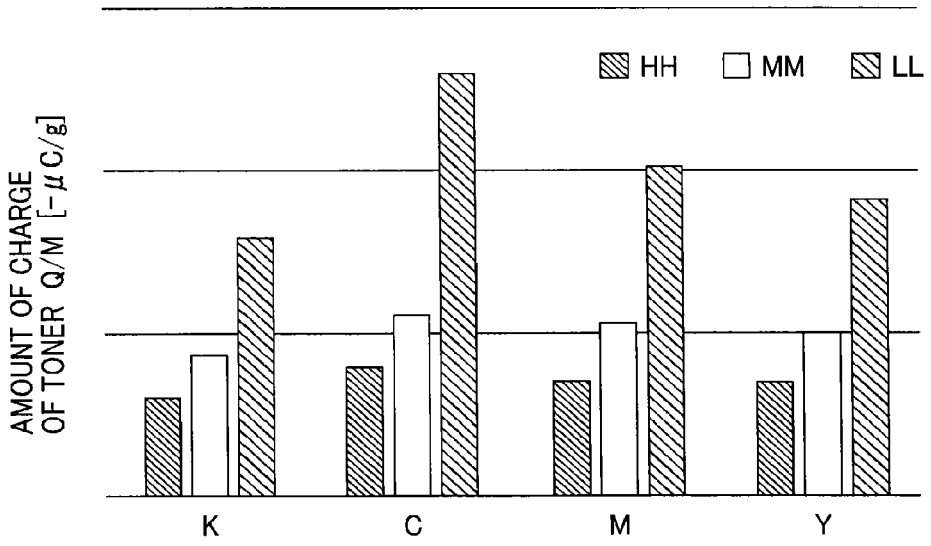
FIG. 10 is a graph of a relationship between the charge amount Q/M of a toner image of each color on the surface of the photoconductor before entering the primary transfer nip, and an environment.

As illustrated in FIG. 10, MM represents a moderate temperature and moderate humidity environment. For example, MM is an environment in which a temperature is set to 23° C. and humidity is set to 50% (corresponds to 8.6 g/m$^3$ in absolute humidity). In addition, HH represents a high temperature and high humidity environment. For example, HH is an environment in which a temperature is set to 27° C. and humidity is set to 80% (corresponds to 20.6 g/m$^3$ in absolute humidity). In addition, LL represents a low temperature and low humidity environment. For example, LL is an environment in which a temperature is set to 10° C. and humidity is set to 15% (corresponds to 1.4 g/m$^3$ in absolute humidity). LL is an environment in which a frictional charge amount of toner is set to be greater in comparison to MM or HH. In addition, MM is an environment in which the frictional charge amount of toner is set to be greater in comparison to HH. In addition, HH is an environment in which the frictional charge amount of toner is set to be smaller in comparison to MM or LL. In addition, MM is an environment in which the frictional charge amount of toner is set to be smaller in comparison to LL.

As illustrated in FIG. 10, in HH, in all colors of yellow, magenta, cyan, and black, the toner charge amount Q/M becomes smaller than a charge amount of the black toner in MM. Accordingly, in HH, even in the full-color mode, when not using a bias in which polarity is reversed in one cycle is used as the secondary transfer bias, deficiency in an image density may occur due to the secondary transfer failure that is caused by injection of charges of the opposite polarity to toners.

Furthermore, in LL, in all colors of yellow, magenta, cyan, and black, the toner charge amount Q/M becomes greater than a toner charge amount in MM. Accordingly, in LL, even in the monochromatic mode, when not using a bias in which polarity is not reversed, and the peak-to-peak transitions only in a negative side polarity as the secondary transfer bias, deficiency in an image density may occur due to deficiency of a secondary transfer electric field.

Furthermore, in MM, as is the case with the first embodiment, when not using a secondary transfer bias in which polarity is reversed in one cycle in the monochromatic mode, deficiency in an image density may occur due to the secondary transfer failure that is caused by injection of charges of the opposite polarity to toners. In contrast, when not using a bias in which a polarity is not reversed, and the peak-to-peak transitions only in a negative side polarity in the color mode, deficiency in an image density may occur due to deficiency of a secondary transfer electric field.

Figure 11:
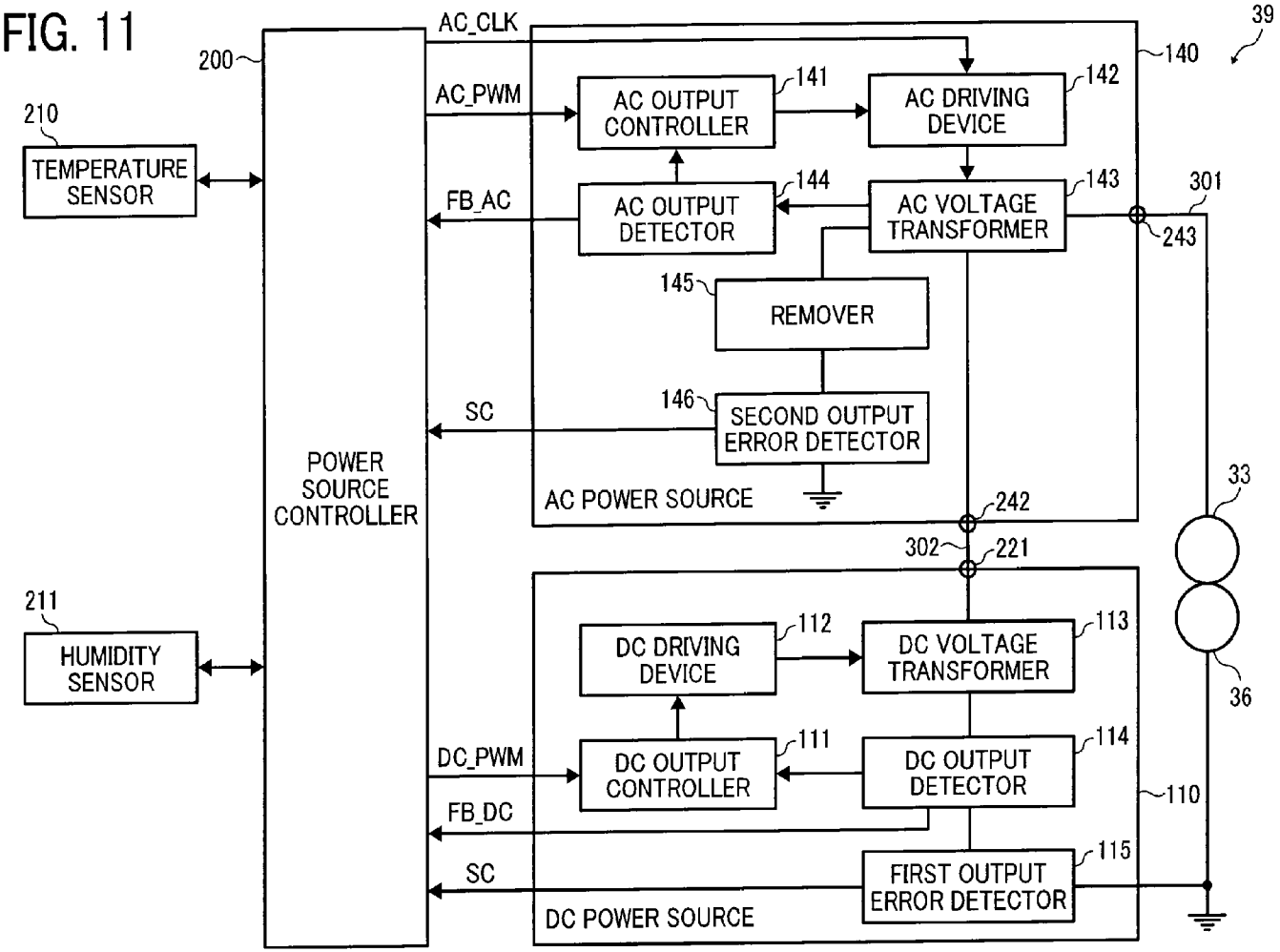

FIG. 11 is a block diagram illustrating main portions of the electrical circuit of the secondary transfer power source in the image forming apparatus according to the second embodiment in combination with the secondary-transfer first roller 33, the secondary-transfer second roller 36, and the like. As illustrated in FIG. 11, a temperature sensor 210 that measures a temperature in an apparatus, and a humidity sensor 211 that measures humidity in the apparatus are connected to the power source controller 200. The power source controller 200 can grasp the temperature in the apparatus on the basis of an output from the temperature sensor 210, or can grasp the humidity in the apparatus on the basis of an output from the humidity sensor 211. In addition, the power source controller 200 grasps that an environment in the apparatus belongs to any one of HH, MM, and LL on the basis of the results which are grasped. For example, a case where absolute humidity calculated on the basis of the temperature and the humidity is 14.6 g/m$^3$ or greater is set as HH, a case where absolute humidity is equal to or greater than 5 g/m$^3$ and less than 14.6 g/m$^3$ is set as MM, and a case where absolute humidity is less than 5 g/m$^3$ is set as LL.

The following Table 1 is a graph illustrating a relationship between an environment, characteristics of the secondary transfer bias, and a print mode in the image forming apparatus according to the second embodiment.

TABLE 1

| | Change in Polarity of Bias | |
|---|---|---|
| Environment | Full color | Monochrome |
| HH | Reversed | Reversed |
| MM | One side only | Reversed |
| LL | One side only | One side only |

Figure 12:
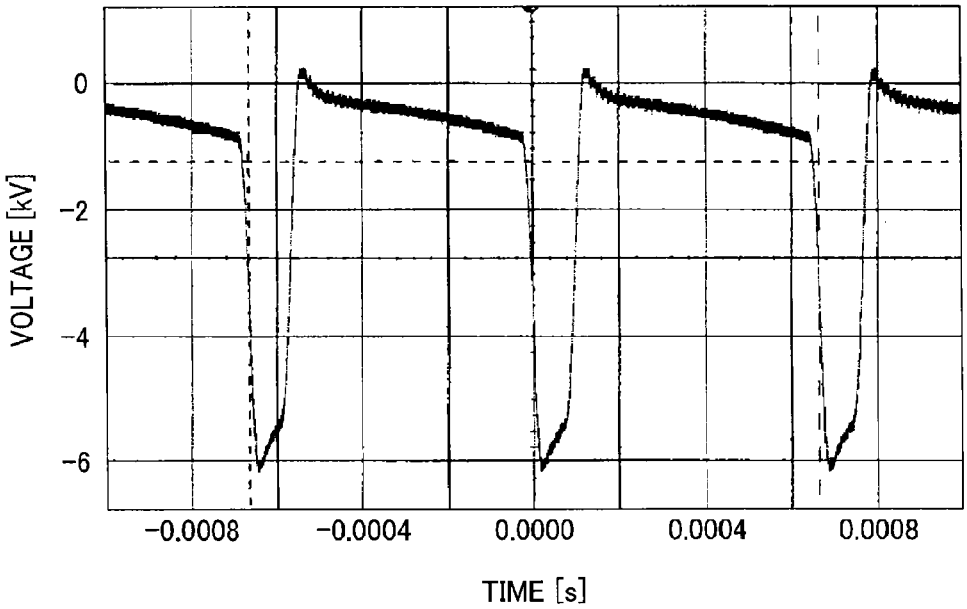
FIG. 12 is a graph of a variation in a secondary transfer bias, which is used in a case where the environment is HH and a print mode is a full-color mode, with the passage of time.
Figure 13:
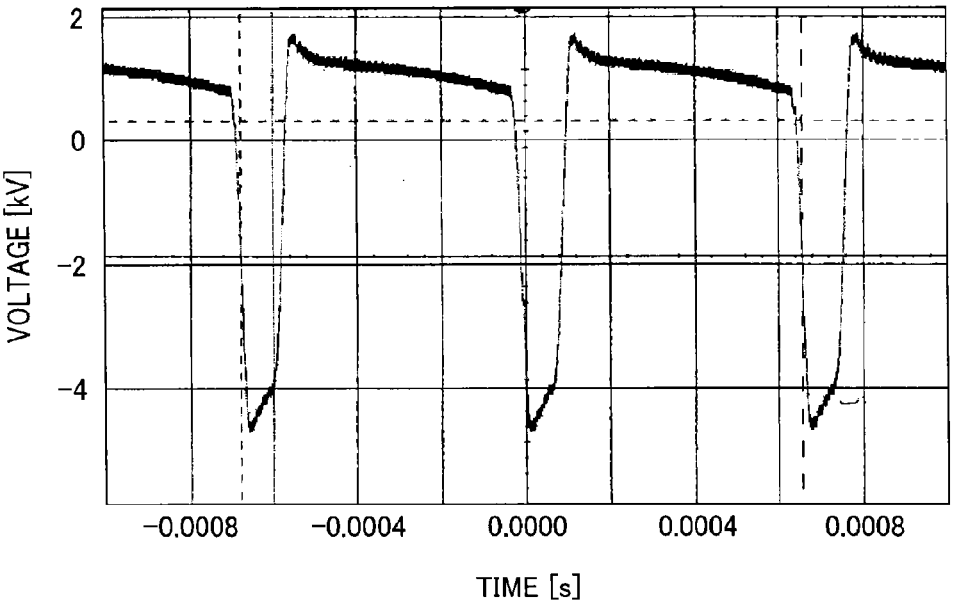
FIG. 13 is a graph of a variation in a secondary transfer bias, which is used in a case where the environment is HH and the print mode is a monochromatic mode, with the passage of time.

As illustrated in Table 1, in a case where the environment is HH in which the toner charge amount is set to be relatively small, the power source controller 200 outputs a secondary transfer bias, in which polarity is periodically reversed, from the secondary transfer power source 39 in the color mode and the monochromatic mode, respectively. More specifically, in a case where the environment is HH, and the print mode is the full-color mode, a secondary transfer bias having characteristics illustrated in FIG. 12 is output from the secondary transfer power source 39. In addition, in a case where the environment is HH, and the print mode is the monochromatic mode, a secondary transfer bias having characteristics illustrated in FIG. 13 is output from the secondary transfer power source 39. Although all of the secondary transfer biases have characteristics in which polarity is reversed in one cycle, in the secondary transfer bias that is used in the color mode, the second peak value $V_2$ (a peak value on a positive side) becomes lower in comparison to the secondary transfer bias that is used in the monochromatic mode. According to this, in the secondary transfer bias that is used in the color mode, electric field intensity thereof in the transfer direction is set to be stronger in comparison to the secondary transfer bias that is used in the monochromatic mode.

Figure 14:
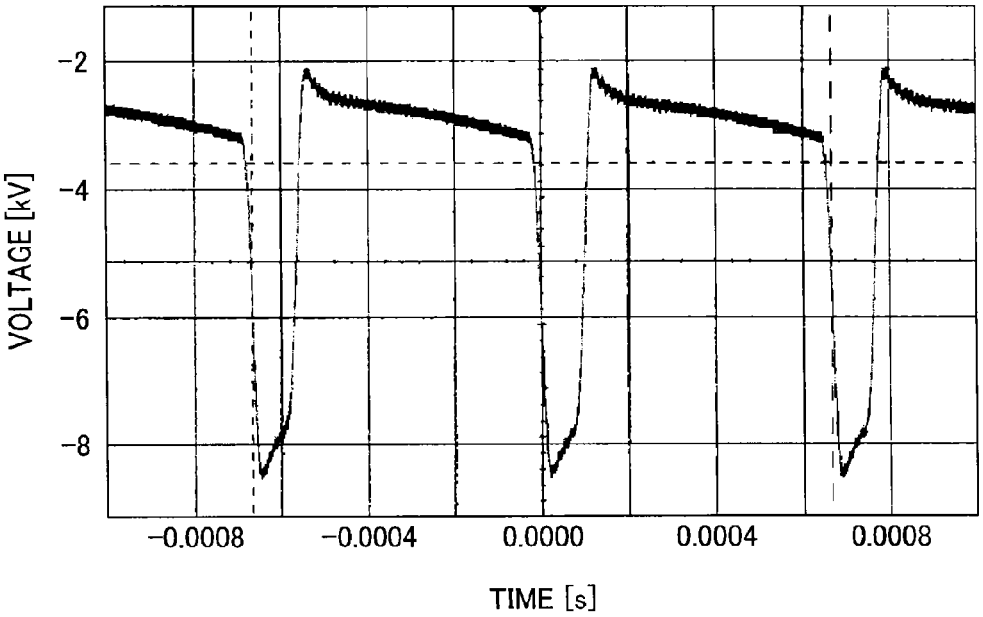
FIG. 14 is a graph of a variation in a secondary transfer bias, which is used in a case where the environment is LL and the print mode is the full-color mode, with the passage of time.

In addition, in a case where the environment is MM or LL, and the print mode is the full-color mode, the power source controller 200 outputs a secondary transfer bias, in which polarity is not reversed and transitions only on a negative side, from the secondary transfer power source 39. More specifically, in a case where the environment is MM and the print mode is the full-color mode, a secondary transfer bias having characteristics illustrated in FIG. 6 is output from the secondary transfer power source 39. In addition, in a case where the environment is LL, and the print mode is the full-color mode, a secondary transfer bias having characteristics illustrated in FIG. 14 is output from the secondary transfer power source 39. All of the secondary transfer biases have characteristics in which transition occurs only in a negative side polarity, in the case of MM, the absolute value of the second peak value $V_2$ becomes lower in comparison to the case of LL. According to this, in the case of MM, injection of charges of the opposite polarity to toner is further suppressed in comparison to the case of LL.

In addition, in a case where the environment is MM, and the print mode is the monochromatic mode, the power source controller 200 outputs a secondary transfer bias having characteristics illustrated in FIG. 8 from the secondary transfer power source 39. The secondary transfer bias is a secondary transfer bias having characteristics in which polarity is reversed in one cycle, and thus it is possible to suppress occurrence of deficiency in an image density due to injection of charges of the opposite polarity to toner.

Figure 15:
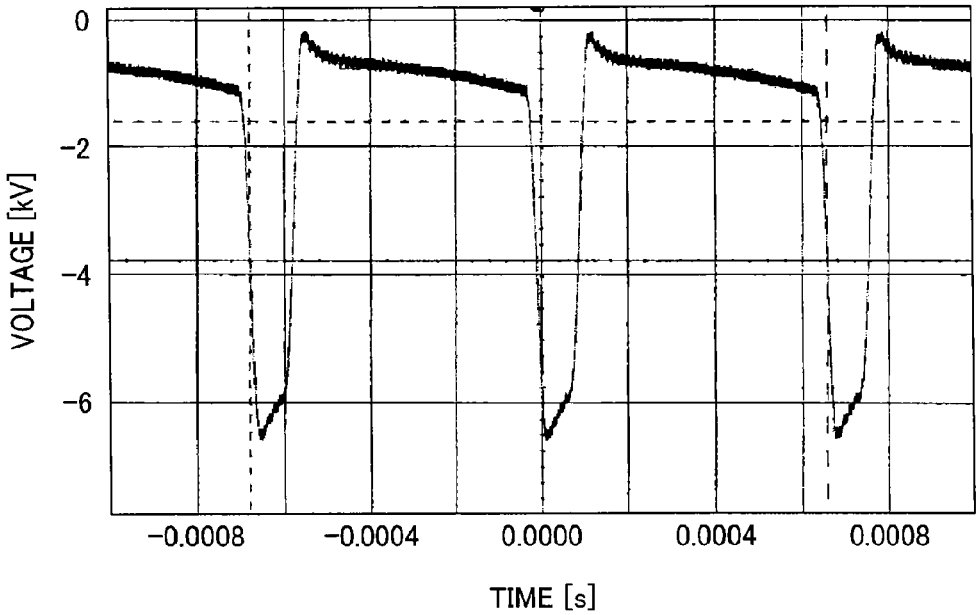
FIG. 15 is a graph of a variation in a secondary transfer bias, which is used in a case where the environment is LL and the print mode is the monochromatic mode, with the passage of time.

In addition, in a case where the environment is LL, and the print mode is the monochromatic mode, the power source controller 200 outputs a secondary transfer bias having characteristics illustrated in FIG. 15 from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

In the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

Furthermore, differently from the graph in FIG. 10, in HH, the toner charge amount Q/M may be greater than the charge amount of the black toner in MM at least at a part of yellow, magenta, and cyan depending on the kind of toner. In addition, in LL, the toner charge amount Q/M may become smaller than a toner charge amount in MM at least at a part of yellow, magenta, and cyan. In these cases, for example, characteristics of the secondary transfer bias may be selected from relationships illustrated in Table 2 to Table 5. The characteristics of Table 1 to Table 5 are common as follows. In HH, a polarity is reversed in both the full-color mode and the monochromatic mode. In contrast, transition occurs only in a negative side in the full-color mode in LL.

TABLE 2

| | Change in Polarity of Bias | |
|---|---|---|
| Environment | Full color | Monochrome |
| HH | Reversed | Reversed |
| MM | Reversed | Reversed |
| LL | One side only | Reversed |

TABLE 3

| | Change in Polarity of Bias | |
|---|---|---|
| Environment | Full color | Monochrome |
| HH | Reversed | Reversed |
| MM | One side only | Reversed |
| LL | One side only | Reversed |

TABLE 4

| | Change in Polarity of Bias | |
|---|---|---|
| Environment | Full color | Monochrome |
| HH | Reversed | Reversed |
| MM | One side only | Reversed |

TABLE 5

| | Change in Polarity of Bias | |
|---|---|---|
| Environment | Full color | Monochrome |
| HH | Reversed | Reversed |
| LL | One side only | One side only |

In addition, with regard to secondary transfer biases having respective characteristics, description has been given of an example in which the peak-to-peak Vpp or the duty is set to be constant, but in the secondary transfer biases having respective characteristics, the peak-to-peak value or the duty may be set to be different. In addition, in the secondary transfer bias having characteristics in which transition occurs on a negative side, a bias, which is composed of a direct current voltage instead of a superimposed voltage, may be employed. In addition, description has been given of an example in which all of the temperature and the humidity are detected as the environment, but the secondary transfer bias may be controlled on the basis of a result obtained by detecting only the temperature or the humidity.

Next, description will be given of an image forming apparatus of Variation 2-1 in which the configuration of a part of the image forming apparatus according to the second embodiment is modified into a different configuration. Furthermore, the configuration of the image forming apparatus according to Variation 2-1 is the same as in the second embodiment unless otherwise stated.

In the image forming apparatus according to Variation 2-1, toner, which does not contain carbon black, is used as the black toner. Accordingly, the "low charge amount caused by carbon" does not occur. In addition, the toner image forming unit 1K for black is disposed at a position on a most upstream side, and the toner image forming unit 1C for cyan is disposed at a position on a most downstream side. In the above-described configuration, as is the case with the image forming apparatus according to Variation 1-2, the charge amount Q/M of the cyan toner becomes the smallest among respective colors of toner immediately before entering the secondary transfer nip.

In the image forming apparatus according to Variation 2-1, the power source controller 200 is configured to control the secondary transfer bias similar to Table 6.

TABLE 6

| | Change in Polarity of Bias | |
|---|---|---|
| Environment | At least black | Cyan only |
| HH | Reversed | Reversed |
| MM | One side only | Reversed |
| LL | One side only | One side only |

As illustrated in Table 6, in a case where the environment is HH in which the toner charge amount is set to be relatively small, the power source controller 200 outputs the following secondary transfer bias from the secondary transfer power source 39. That is, in a case where the black toner image, which is carried on the photoconductor 2K for black as the most upstream-side image bearer, is secondary-transferred, and in a case where only the cyan toner image, which is carried on the photoconductor 2C for cyan as the most downstream-side image bearer, is secondary-transferred, a secondary transfer bias, in which polarity is periodically reversed, is used. More specifically, in a case where the environment is HH, and the black toner image is secondary-transferred, a secondary transfer bias having characteristics illustrated in FIG. 12 is output from the secondary transfer power source 39. In addition, in a case where the environment is HH, and a single-color cyan toner image is secondary-transferred, a secondary transfer bias having characteristics illustrated in FIG. 13 is output from the secondary transfer power source 39. All of the secondary transfer biases have characteristics in which polarity is reversed in one cycle. However, in a secondary transfer bias that is used when secondary-transferring the black toner image, the second peak value $V_2$ (a peak value on a positive side) becomes lower in comparison to the secondary transfer bias that is used when secondary-transferring the single-color cyan toner image. According to this, electric field intensity in the transfer direction is set to be stronger in comparison to the case of forming the single-color cyan toner image.

In addition, in a case where the environment is MM or LL, and the black toner image is secondary-transferred, the power source controller 200 outputs a secondary transfer bias in which polarity is not reversed and transitions only on a negative side, from the secondary transfer power source 39. More specifically, in a case where the environment is MM, and the black toner image is secondary-transferred, a secondary transfer bias having characteristics illustrated in FIG. 6 is output from the secondary transfer power source 39. In addition, in a case where the environment is LL, and the black toner image is secondary-transferred, a secondary transfer bias having characteristics illustrated in FIG. 14 is output from the secondary transfer power source 39. All of the secondary transfer biases have characteristics in which transition occurs only in a negative side polarity, in the case of MM, the absolute value of the second peak value $V_2$ becomes lower in comparison to the case of LL. According to this, in the case of MM, injection of charges of the opposite polarity to toner is further suppressed in comparison to the case of LL.

In addition, in a case where the environment is MM, and a single-color cyan toner image is secondary-transferred, the power source controller 200 outputs a secondary transfer bias having characteristics illustrated in FIG. 8 from the secondary transfer power source 39. The secondary transfer bias is a secondary transfer bias having characteristics in which polarity is reversed in one cycle, and thus it is possible to suppress occurrence of deficiency in an image density due to injection of charges of the opposite polarity to toner.

In addition, in a case where the environment is LL, and a single-color cyan toner image is secondary-transferred, the power source controller 200 outputs a secondary transfer bias having characteristics illustrated in FIG. 15 from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

Even in the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

Furthermore, for example, characteristics of the secondary transfer bias may be selected from relationships illustrated in Table 7 to Table 10 depending on the kind of toner. The characteristics of Table 6 to Table 10 are common as follows. In HH, a polarity is reversed both in the case of secondary-transferring the black toner image and in the case of secondary-transferring the single-color cyan toner image. In contrast, in LL, in the case of secondary-transferring the black toner image, transition occurs only in a negative side.

TABLE 7

| | Change in Polarity of Bias | |
|---|---|---|
| Environment | At least black | Cyan only |
| HH | Reversed | Reversed |
| MM | Reversed | Reversed |
| LL | One side only | Reversed |

TABLE 8

| | Change in Polarity of Bias | |
|---|---|---|
| Environment | At least black | Cyan only |
| HH | Reversed | Reversed |
| MM | One side only | Reversed |
| LL | One side only | Reversed |

TABLE 9

| | Change in Polarity of Bias | |
|---|---|---|
| Environment | At least black | Cyan only |
| HH | Reversed | Reversed |
| MM | One side only | Reversed |

TABLE 10

| | Change in Polarity of Bias | |
|---|---|---|
| Environment | At least black | Cyan only |
| HH | Reversed | Reversed |
| LL | One side only | One side only |

Next, description will be given of an image forming apparatus according to Variation 2-2. The configuration of the image forming apparatus according to Variation 2-2 is the same as in the second embodiment unless otherwise stated.

Even in the image forming apparatus according to Variation 2-2, toner, which does not contain carbon black, is used as the black toner. Accordingly, the "low charge amount caused by carbon" does not occur. As is the case with the second embodiment, the toner image forming units for respective colors are disposed in the order of yellow, magenta, cyan, and black, and black is disposed on a most downstream side. The charge amount Q/M of the cyan toner in the cyan toner image becomes the smallest among toner images, which are individually secondary-transferred to the intermediate transfer belt 31, due to characteristics of the respective colors of toner or arrangement positions thereof.

In the image forming apparatus according to Variation 2-2, the power source controller 200 is configured to control the secondary transfer bias similar to Table 11.

TABLE 11

| | Change in Polarity of Bias | |
|---|---|---|
| Environment | At least yellow | Cyan only |
| HH | Reversed | Reversed |
| MM | One side only | Reversed |
| LL | One side only | One side only |

As illustrated in Table 11, in a case where the environment is HH in which the toner charge amount is set to be relatively small, the power source controller 200 outputs the following secondary transfer bias from the secondary transfer power source 39. A secondary transfer bias having the same characteristics is used even in the case of secondary-transferring the yellow toner image as a maximum-charge-amount toner image in which the charge amount Q/M before secondary transfer becomes the greatest, and even in the case of secondary-transferring only the cyan toner image as a minimum-charge-amount toner image in which the charge amount Q/M before secondary transfer becomes the smallest. The secondary transfer bias has characteristics in which polarity is periodically reversed. More specifically, in a case where the environment is HH, and the yellow toner image is secondary-transferred, a secondary transfer bias having characteristics illustrated in FIG. 12 is output from the secondary transfer power source 39. In addition, in a case where the environment is HH, and a single-color cyan toner image is secondary-transferred, a secondary transfer bias having characteristics illustrated in FIG. 13 is output from the secondary transfer power source 39. All of the secondary transfer biases have characteristics in which polarity is reversed in one cycle. However, in a secondary transfer bias that is used when secondary-transferring the yellow toner image, the second peak value $V_2$ (a peak value on a positive side) becomes lower in comparison to the secondary transfer bias that is used when secondary-transferring the single-color cyan toner image. According to this, electric field intensity in the transfer direction is set to be stronger in comparison to the case of forming the single-color cyan toner image.

In addition, in a case where the environment is MM or LL, and the yellow toner image is secondary-transferred, the power source controller 200 outputs a secondary transfer bias in which polarity is not reversed and transitions only on a negative side, from the secondary transfer power source 39. More specifically, in a case where the environment is MM, and the yellow toner image is secondary-transferred, a secondary transfer bias having characteristics illustrated in FIG. 6 is output from the secondary transfer power source 39. In addition, in a case where the environment is LL, and the yellow toner image is secondary-transferred, a secondary transfer bias having characteristics illustrated in FIG. 14 is output from the secondary transfer power source 39. All of the secondary transfer biases have characteristics in which transition occurs only in a negative side polarity, in the case of MM, the absolute value of the second peak value $V_2$ becomes lower in comparison to the case of LL. According to this, in the case of MM, injection of charges of the opposite polarity to toner is further suppressed in comparison to the case of LL.

In addition, in a case where the environment is MM, and a single-color cyan toner image is secondary-transferred, the power source controller 200 outputs a secondary transfer bias having characteristics illustrated in FIG. 8 from the secondary transfer power source 39. The secondary transfer bias is a secondary transfer bias having characteristics in which polarity is reversed in one cycle, and thus it is possible to suppress occurrence of deficiency in an image density due to injection of charges of the opposite polarity to toner.

In addition, in a case where the environment is LL, and a single-color cyan toner image is secondary-transferred, the power source controller 200 outputs a secondary transfer bias having characteristics illustrated in FIG. 15 from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

Even in the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

Furthermore, for example, characteristics of the secondary transfer bias may be selected from relationships illustrated in Table 12 to Table 15 depending on the kind of toner. The characteristics of Table 11 to Table 15 are common as follows. In HH, a polarity is reversed both in the case of secondary-transferring the yellow toner image and in the case of secondary-transferring the single-color cyan toner image. In contrast, in LL, in the case of secondary-transferring the yellow toner image, transition occurs only in a negative side.

TABLE 12

| | Change in Polarity of Bias | |
|---|---|---|
| Environment | At least yellow | Cyan only |
| HH | Reversed | Reversed |
| MM | Reversed | Reversed |
| LL | One side only | Reversed |

TABLE 13

| | Change in Polarity of Bias | |
|---|---|---|
| Environment | At least yellow | Cyan only |
| HH | Reversed | Reversed |
| MM | One side only | Reversed |
| LL | One side only | Reversed |

TABLE 14

| | Change in Polarity of Bias | |
|---|---|---|
| Environment | At least yellow | Cyan only |
| HH | Reversed | Reversed |
| MM | One side only | Reversed |

TABLE 15

| Environment | Change in Polarity of Bias | |
|---|---|---|
| | At least yellow | Cyan only |
| HH | Reversed | Reversed |
| LL | One side only | One side only |

Next, description will be given of the image forming apparatus according to a third embodiment of the present disclosure. Furthermore, the basic configuration of the image forming apparatus according to the third embodiment is the same as in the image forming apparatus according to the first embodiment, and thus description thereof will not be repeated.

As is the case with the image forming apparatus according to the second embodiment, the image forming apparatus according to the third embodiment includes the temperature sensor 210 that measures a temperature in the apparatus, and the humidity sensor 211 that measures humidity in the apparatus. The power source controller 200 grasps that an environment in the apparatus belongs to any one of HH, MM, and LL on the basis of the results which are detected. For example, a case where absolute humidity calculated on the basis of the temperature and the humidity is 14.6 g/m$^3$ or greater is set as HH, a case where absolute humidity is equal to or greater than 5 g/m$^3$ and less than 14.6 g/m$^3$ is set as MM, and a case where absolute humidity is less than 5 g/m$^3$ is set as LL.

The following Table 16 is a graph illustrating a relationship between an environment, characteristics of the secondary transfer bias, and a print mode in the image forming apparatus according to the third embodiment.

TABLE 16

| Environment | Change in Polarity of Bias | |
|---|---|---|
| | Full color | Monochrome |
| HH | Reversed | Reversed |
| MM | Reversed | Reversed |
| LL | One side only | One side only |

As illustrated in Table 16, in a case where the environment is HH in which the toner charge amount is set to be relatively small, the power source controller 200 outputs a secondary transfer bias, in which polarity is periodically reversed, from the secondary transfer power source 39 in the color mode and the monochromatic mode, respectively. More specifically, in a case where the environment is HH, and the print mode is the full-color mode, a secondary transfer bias having characteristics illustrated in FIG. 12 is output from the secondary transfer power source 39. In addition, in a case where the environment is HH, and the print mode is the monochromatic mode, a secondary transfer bias having characteristics illustrated in FIG. 13 is output from the secondary transfer power source 39. Although all of the secondary transfer biases have characteristics in which polarity is reversed in one cycle, in the secondary transfer bias that is used in the color mode, the second peak value $V_2$ (a peak value on a positive side) becomes lower in comparison to the secondary transfer bias that is used in the monochromatic mode. According to this, in the secondary transfer bias that is used in the color mode, electric field intensity thereof in the transfer direction is set to be stronger in comparison to the secondary transfer bias that is used in the monochromatic mode.

In addition, even in a case where the environment is MM, the power source controller 200 outputs a secondary transfer bias, in which polarity is periodically reversed, from the secondary transfer power source 39 in the color mode and the monochromatic mode, respectively. More specifically, in a case where the environment is MM and the print mode is the full-color mode, a secondary transfer bias having characteristics illustrated in FIG. 12 is output from the secondary transfer power source 39. In addition, in a case where the environment is MM and the print mode is the monochromatic mode, a secondary transfer bias having characteristics illustrated in FIG. 13 is output from the secondary transfer power source 39. All of the secondary transfer biases have characteristics in which polarity is reversed in one cycle.

In addition, in a case where the environment is LL in which the toner charge amount is set to be relatively great, the power source controller 200 uses a secondary transfer bias in which transition occurs only on a negative side in both of the color mode and the monochromatic mode. More specifically, in a case where the environment is LL, and the print mode is the full-color mode, a secondary transfer bias having characteristics illustrated in FIG. 14 is output from the secondary transfer power source 39. In addition, in a case where the environment is LL, and the print mode is the monochromatic mode, a secondary transfer bias having characteristics illustrated in FIG. 15 is output from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

Even in the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

In these cases, for example, characteristics of the secondary transfer bias may be selected from relationships illustrated in Table 17 to Table 19 depending on the kind of toner. The characteristics of Table 16 to Table 19 are common as follows. In LL, a secondary transfer bias, in which transition occurs only on a negative side, is used in both of the full-color mode and the monochromatic mode. In addition, a secondary transfer bias in which polarity is reversed is used in the monochromatic mode in HH or MM.

TABLE 17

| Environment | Change in Polarity of Bias | |
|---|---|---|
| | Full color | Monochrome |
| HH | Reversed | Reversed |
| MM | One side only | One side only |
| LL | One side only | One side only |

TABLE 18

| Environment | Change in Polarity of Bias | |
|---|---|---|
| | Full color | Monochrome |
| MM | Reversed | Reversed |
| LL | One side only | One side only |

TABLE 19

| | Change in Polarity of Bias | |
|---|---|---|
| Environment | Full color | Monochrome |
| MM | One side only | Reversed |
| LL | One side only | One side only |

In addition, with regard to secondary transfer biases having respective characteristics, description has been given of an example in which the peak-to-peak Vpp or the duty is set to be constant, but in the secondary transfer biases having respective characteristics, the peak-to-peak value or the duty may be set to be different. In addition, in the secondary transfer bias having characteristics in which transition occurs on a negative side, a bias, which is composed of a direct current voltage instead of a superimposed voltage, may be employed.

Next, description will be given of an image forming apparatus of Variation 3-1 in which the configuration of a part of the image forming apparatus according to the third embodiment is modified into a different configuration. Furthermore, the configuration of the image forming apparatus according to Variation 3-1 is the same as in the third embodiment unless otherwise stated.

In the image forming apparatus according to Variation 3-1, toner, which does not contain carbon black, is used as the black toner. Accordingly, the "low charge amount caused by carbon" does not occur. In addition, the toner image forming unit 1K for black is disposed at a position on a most upstream side, and the toner image forming unit 1C for cyan is disposed at a position on a most downstream side. In the above-described configuration, as is the case with the image forming apparatus according to Variation 1-2, the charge amount Q/M of the cyan toner becomes the smallest among respective colors of toner immediately before entering the secondary transfer nip.

In the image forming apparatus according to Variation 3-1, the power source controller 200 is configured to control the secondary transfer bias similar to Table 20.

TABLE 20

| | Change in Polarity of Bias | |
|---|---|---|
| Environment | At least black | Cyan only |
| HH | Reversed | Reversed |
| MM | Reversed | Reversed |
| LL | One side only | One side only |

As illustrated in Table 20, in a case where the environment is HH in which the toner charge amount is set to be relatively small, the power source controller 200 outputs the following secondary transfer bias from the secondary transfer power source 39. That is, in a case where the black toner image, which is carried on the photoconductor 2K for black as the most upstream-side image bearer, is secondary-transferred, and in a case where only the cyan toner image, which is carried on the photoconductor 2C for cyan as the most downstream-side image bearer, is secondary-transferred, a secondary transfer bias, in which polarity is periodically reversed, is used. More specifically, in a case where the environment is HH, and the black toner image is secondary-transferred, a secondary transfer bias having characteristics illustrated in FIG. 12 is output from the secondary transfer power source 39. In addition, in a case where the environment is HH, and a single-color cyan toner image is secondary-transferred, a secondary transfer bias having characteristics illustrated in FIG. 13 is output from the secondary transfer power source 39. All of the secondary transfer biases have characteristics in which polarity is reversed in one cycle. However, in a secondary transfer bias that is used when secondary-transferring the black toner image, the second peak value $V_2$ (a peak value on a positive side) becomes lower in comparison to the secondary transfer bias that is used when secondary-transferring the single-color cyan toner image. According to this, electric field intensity in the transfer direction is set to be stronger in comparison to the case of forming the single-color cyan toner image.

In addition, even in a case where the environment is MM, the power source controller 200 uses a secondary transfer bias, in which polarity is periodically reversed, both in the case of secondary-transferring the black toner image and in the case of secondary-transferring the single-color cyan toner image. More specifically, in a case where the environment is MM, and the black toner image is secondary-transferred, a secondary transfer bias having characteristics illustrated in FIG. 12 is output from the secondary transfer power source 39. In addition, in a case where the environment is MM, and the single-color cyan toner image is secondary-transferred, a secondary transfer bias having characteristics illustrated in FIG. 13 is output from the secondary transfer power source 39. All of the secondary transfer biases have characteristics in which polarity is reversed in one cycle.

In addition, in a case where the environment is LL, the power source controller 200 uses a secondary transfer bias, in which transition occurs only on a negative side, both in the case of secondary-transferring the black toner image and in the case of secondary-transferring the single-color cyan toner image. More specifically, in a case where the environment is LL, and the black toner image is secondary-transferred, a secondary transfer bias having characteristics illustrated in FIG. 14 is output from the secondary transfer power source 39. In addition, in a case where the environment is LL, and the single-color cyan toner image is secondary-transferred, a secondary transfer bias having characteristics illustrated in FIG. 15 is output from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

Even in the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

Furthermore, for example, characteristics of the secondary transfer bias may be selected from relationships illustrated in Table 21 to Table 23 depending on the kind of toner. The characteristics of Table 20 to Table 23 are common as follows. In LL, a secondary transfer bias, in which transition occurs only on a negative side, is used both in the case of secondary-transferring the black toner image and in the case of secondary-transferring the single-color cyan toner image. In addition, the characteristics are also common in that in the case of secondary-transferring the black toner image in HH or MM, a secondary transfer bias, in which polarity is reversed, is used.

TABLE 21

| Environment | Change in Polarity of Bias | |
|---|---|---|
| | At least black | Cyan only |
| HH | Reversed | Reversed |
| MM | One side only | One side only |
| LL | One side only | One side only |

TABLE 22

| Environment | Change in Polarity of Bias | |
|---|---|---|
| | At least black | Cyan only |
| MM | Reversed | Reversed |
| LL | One side only | One side only |

TABLE 23

| Environment | Change in Polarity of Bias | |
|---|---|---|
| | At least black | Cyan only |
| MM | One side only | Reversed |
| LL | One side only | One side only |

Next, description will be given of an image forming apparatus according to Variation 3-2. The configuration of the image forming apparatus according to Variation 3-2 is the same as in the third embodiment unless otherwise stated.

Even in the image forming apparatus according to Variation 3-2, toner, which does not contain carbon black, is used as the black toner. Accordingly, the "low charge amount caused by carbon" does not occur. As is the case with the third embodiment, the toner image forming units for respective colors are disposed in the order of yellow, magenta, cyan, and black, and black is disposed on a most downstream side. The charge amount Q/M of the cyan toner in the cyan toner image becomes the smallest among toner images, which are individually secondary-transferred to the intermediate transfer belt 31, due to characteristics of the respective colors of toner or arrangement positions thereof.

In the image forming apparatus according to Variation 3-2, the power source controller 200 is configured to control the secondary transfer bias similar to Table 24.

TABLE 24

| Environment | Change in Polarity of Bias | |
|---|---|---|
| | At least yellow | Cyan only |
| HH | Reversed | Reversed |
| MM | Reversed | Reversed |
| LL | One side only | One side only |

As illustrated in Table 24, in a case where the environment is HH in which the toner charge amount is set to be relatively small, the power source controller 200 outputs the following secondary transfer bias from the secondary transfer power source 39. A secondary transfer bias having the same characteristics is used even in the case of secondary-transferring the yellow toner image as a maximum-charge-amount toner image in which the charge amount Q/M before secondary transfer becomes the greatest, and even in the case of secondary-transferring only the cyan toner image as a minimum-charge-amount toner image in which the charge amount Q/M before secondary transfer becomes the smallest. The secondary transfer bias has characteristics in which polarity is periodically reversed. More specifically, in a case where the environment is HH, and the yellow toner image is secondary-transferred, a secondary transfer bias having characteristics illustrated in FIG. 12 is output from the secondary transfer power source 39. In addition, in a case where the environment is HH, and a single-color cyan toner image is secondary-transferred, a secondary transfer bias having characteristics illustrated in FIG. 13 is output from the secondary transfer power source 39. All of the secondary transfer biases have characteristics in which polarity is reversed in one cycle. However, in a secondary transfer bias that is used when secondary-transferring the yellow toner image, the second peak value $V_2$ (a peak value on a positive side) becomes lower in comparison to the secondary transfer bias that is used when secondary-transferring the single-color cyan toner image. According to this, electric field intensity in the transfer direction is set to be stronger in comparison to the case of forming the single-color cyan toner image.

In addition, even in a case where the environment is MM, the power source controller 200 outputs the following secondary transfer bias from the secondary transfer power source 39. A secondary transfer bias having the same characteristics is used even in the case of secondary-transferring the yellow toner image as a maximum-charge-amount toner image in which the charge amount Q/M before secondary transfer becomes the greatest, and even in the case of secondary-transferring only the cyan toner image as a minimum-charge-amount toner image in which the charge amount Q/M before secondary transfer becomes the smallest. The secondary transfer bias has characteristics in which polarity is periodically reversed. More specifically, in a case where the environment is MM, and the yellow toner image is secondary-transferred, a secondary transfer bias having characteristics illustrated in FIG. 12 is output from the secondary transfer power source 39. In addition, in a case where the environment is MM, and the single-color cyan toner image is secondary-transferred, a secondary transfer bias having characteristics illustrated in FIG. 13 is output from the secondary transfer power source 39. All of the secondary transfer biases have characteristics in which polarity is reversed in one cycle.

In addition, in a case where the environment is LL, the power source controller 200 outputs the following secondary transfer bias from the secondary transfer power source 39. A secondary transfer bias having the same characteristics is used even in the case of secondary-transferring the yellow toner image as a maximum-charge-amount toner image in which the charge amount Q/M before secondary transfer becomes the greatest, and even in the case of secondary-transferring only the cyan toner image as a minimum-charge-amount toner image in which the charge amount Q/M before secondary transfer becomes the smallest. In the secondary transfer bias, transition occurs only on a negative side. More specifically, in a case where the environment is LL, and the yellow toner image is secondary-transferred, a secondary transfer bias having characteristics illustrated in FIG. 14 is output from the secondary transfer power source 39. In addition, in a case where the environment is LL, and the single-color cyan toner image is secondary-transferred, a secondary transfer bias having characteristics illustrated in FIG. 15 is output from the secondary transfer power source 39. As is the case with the secondary transfer bias illustrated in FIG. 14, in this secondary transfer bias, transition occurs only in a negative side polarity. However, the absolute value of the second peak value $V_2$ becomes lower in comparison to the secondary transfer bias illustrated in FIG. 14. According to this, it is possible to further suppress injection of charges of the opposite polarity to toner.

Even in the above-described configuration, it is possible to suppress occurrence of deficiency in an image density due to deficiency in a secondary transfer electric field while suppressing occurrence of deficiency in an image density due to injection of charges of the opposite polarity to toner regardless of the environment.

Furthermore, for example, characteristics of the secondary transfer bias may be selected from relationships illustrated in Table 25 to Table 27 depending on the kind of toner. The characteristics of Table 24 to Table 27 are common as follows. In LL, a secondary transfer bias, in which transition occurs only on a negative side, is used both in the case of secondary-transferring the black toner image and in the case of secondary-transferring the single-color cyan toner image. In addition, the characteristics are also common in that in the case of secondary-transferring the black toner image in HH or MM, a secondary transfer bias, in which polarity is reversed, is used.

TABLE 25

| | Change in Polarity of Bias | |
|---|---|---|
| Environment | At least yellow | Cyan only |
| HH | Reversed | Reversed |
| MM | One side only | One side only |
| LL | One side only | One side only |

TABLE 26

| | Change in Polarity of Bias | |
|---|---|---|
| Environment | At least yellow | Cyan only |
| MM | Reversed | Reversed |
| LL | One side only | One side only |

TABLE 27

| | Change in Polarity of Bias | |
|---|---|---|
| Environment | At least yellow | Cyan only |
| MM | One side only | Reversed |
| LL | One side only | One side only |

Hereinbefore, description has been given of an aspect in which the present disclosure is applied to the image forming apparatus in which toner images of respective colors are primary-transferred to the intermediate transfer belt, and is secondary-transferred to the recording sheet, but the present disclosure is also applicable to an image forming apparatus having the following configuration. That is, examples of the configuration include a configuration in which the toner images of respective colors are transferred in a manner of being directly superimposed on the recording sheet that is conveyed by a conveyor belt and the like. In addition, the present disclose is also applicable to an aspect in which clear toner or white toner is used as toner (non-black toner) other than black.

The above-described embodiments and Variations are limited examples, and the present disclosure includes, for example, the following aspects having advantages.

Aspect A

According to Aspect A, there is provided an image forming apparatus. In the image forming apparatus (for example, the image forming apparatus 1000), toner images of different colors, which are respectively carried on a plurality of image bearers (for example, the photoconductors 2), are transferred to a recording sheet directly or through an intermediate transfer body (for example, the intermediate transfer belt 31). A transfer bias (for example, the secondary transfer bias) including an alternating current component is applied to a transfer bias member (for example, the secondary-transfer first roller 33) so as to transfer the toner images to the recording sheet. Among the toner images of a plurality of colors, a color toner image including black toner and non-black toner is transferred to the recording sheet, or a monochromatic toner image including only black toner is transferred to the recording sheet. In the case of transferring the color toner image to the recording sheet, in the transfer bias that is applied, a second peak value (for example, the second peak value $V_2$), which further decreases an electrostatic force that moves toner from each of the image bearers or the intermediate transfer body toward the recording sheet, between a pair of peak values in a peak-to-peak of the transfer bias has a polarity that exhibits an electrostatic force in a transfer direction which moves the toner from the image bearer or the intermediate transfer body toward the recording sheet, or is zero. In the case of transferring the monochromatic toner image to the recording sheet, in the transfer bias that is applied, the second peak value is zero or has a polarity that exhibits an electrostatic force in a direction opposite to a transfer direction.

In the above-described configuration, in the case of transferring the color toner image, a transfer bias, in which the second peak value has a polarity in the transfer direction or is zero, is used. In contrast, in the case of transferring the monochromatic toner image, a transfer bias, in which the second peak value is zero or has a polarity in a direction that is opposite to the transfer direction, is used. According to this, in the latter case, the amount of charges of the opposite polarity, which are injected to the black toner in a transfer process, is further suppressed in comparison to the former case. Accordingly, it is possible to suppress occurrence of transfer failure in the case of transferring the monochromatic toner image, in which a toner charge amount at a normal polarity becomes the smallest among toner images formed on the plurality of image bearers, to the recording sheet.

Aspect B

According to Aspect B, there is provided an image forming apparatus. In the image forming apparatus, toner images, which are respectively carried on a plurality of image bearers which respectively carry toner images, are transferred to a recording sheet directly or through an intermediate transfer body. A transfer bias including an alternating current component is applied to a transfer bias member so as to transfer the toner images to the recording sheet. A most upstream-side toner image, which is carried on a most upstream-side image bearer that is firstly subjected to a toner image transfer process among a plurality of the image bearers, is transferred to the recording sheet, or a most downstream-side toner image, which is carried on a most downstream-side image bearer that is finally subjected to the toner image transfer process, is transferred to the recording sheet. In the case of transferring the most upstream-side toner image to the recording sheet, in the transfer bias that is applied, a second peak value, which further decreases an electrostatic force that moves toner from each of the image bearers or the intermediate transfer body toward the recording sheet, between a pair of peak values in a peak-to-peak of the transfer bias has a polarity that exhibits an electrostatic force in a transfer direction which moves the toner from the image bearer or the intermediate transfer body toward the recording sheet, or is zero. In the case of transferring only the most downstream-side toner image to the recording sheet, in the transfer bias that is applied, the second peak value is zero or has a polarity that exhibits an electrostatic force in a direction opposite to a transfer direction.

In the above-described configuration, in the case of transferring the most upstream-side toner image, a transfer bias, in which the second peak value has a polarity in a transfer direction or is zero, is used. In contrast, in the case of transferring only the most downstream-side toner image, a transfer bias, in which the second peak value is zero or has a polarity that is opposite to the transfer direction, is used. According to this, in the latter case, the amount of charges of the opposite polarity, which are injected to toner in a transfer process, is further suppressed in comparison to the former case. Accordingly, it is possible to suppress occurrence of transfer failure in the case of transferring only the most downstream-side toner image, in which a toner charge amount at a normal polarity becomes the smallest among toner images formed on the plurality of image bearers, to the recording sheet.

Aspect C

According to Aspect C, there is provided an image forming apparatus. In the image forming apparatus, toner images, which are respectively carried on a plurality of image bearers, are transferred to a recording sheet directly or through an intermediate transfer body. A transfer bias including an alternating current component is applied to a transfer bias member so as to transfer the toner images to the recording sheet. Among the toner images which are respectively carried on the plurality of image bearers, a maximum-charge-amount toner image, in which a toner charge amount immediately before being transferred to the recording sheet becomes the largest, is transferred to the recording sheet, or only a minimum-charge-amount toner image, in which the toner charge amount becomes the smallest, is transferred to the recording sheet. In the case of transferring the maximum-charge-amount toner image to the recording sheet, in the transfer bias that is applied, a second peak value, which further decreases an electrostatic force that moves toner from each of the image bearers or the intermediate transfer body toward the recording sheet, between a pair of peak values in a peak-to-peak of the transfer bias has a polarity that exhibits an electrostatic force in a transfer direction which moves the toner from the image bearer or the intermediate transfer body toward the recording sheet, or is zero. In the case of transferring only the minimum-charge-amount toner image to the recording sheet, in the transfer bias that is applied, the second peak value is zero or has a polarity that exhibits an electrostatic force in a direction opposite to a transfer direction.

In the above-described configuration, in the case of transferring the maximum-charge-amount toner image among the plurality of toner images carried on the plurality of image bearers to the recording sheet, a transfer bias, in which the second peak value has a polarity in the transfer direction or is zero, is used. In contrast, in the case of transferring only the minimum-charge-amount toner image, a transfer bias, in which the second peak value is zero or has a polarity in a direction that is opposite to the transfer direction, is used. According to this, in the latter case, the amount of charges of the opposite polarity, which are injected to toner in a transfer process, is further suppressed in comparison to the former case. Accordingly, it is possible to suppress occurrence of transfer failure in the case of transferring only the minimum-charge-amount toner image, in which a toner charge amount at a normal polarity becomes the smallest among toner images formed on the plurality of image bearers, to the recording sheet.

Aspect D

In Aspect D according to Aspect A, in the case of transferring the monochromatic toner image to the recording sheet, as the transfer bias, a transfer bias, in which an absolute value of a first peak value that is the other peak value in the pair of peak values is made smaller than an absolute value of the first peak value in the case of transferring the color toner image to the recording sheet, is applied.

Aspect E

In Aspect E according to Aspect B, in the case of transferring only the most downstream-side toner image to the recording sheet, as the transfer bias, a transfer bias, in which an absolute value of a first peak value that is the other peak value in the pair of peak values is made smaller than an absolute value of the first peak value in the case of transferring the most upstream-side toner image to the recording sheet, is applied.

Aspect F

In Aspect F according to Aspect C, in the case of transferring only the minimum-charge-amount toner image to the recording sheet, as the transfer bias, a transfer bias, in which an absolute value of a first peak value that is the other peak value in the pair of peak values is made smaller than an absolute value of the first peak value in the case of transferring the maximum-charge-amount toner image to the recording sheet, is applied.

Aspect G

In Aspect G according to Aspect D, the polarity of the second peak value is reversed between the case of transferring the color toner image to the recording sheet and the case of transferring the monochromatic toner image to the recording sheet.

Aspect H

In Aspect H according to Aspect E, in the image forming apparatus according to claim 5, the polarity of the second peak value is reversed between the case of transferring the most upstream-side toner image to the recording sheet and the case of transferring only the most downstream-side toner image to the recording sheet.

Aspect I

In Aspect I according to Aspect F, the polarity of the second peak value is reversed between the case of transferring the maximum-charge-amount toner image to the recording sheet and the case of transferring only the minimum-charge-amount toner image to the recording sheet.

Aspect J

According to Aspect J, there is provided an image forming apparatus. In the image forming apparatus, toner images of different colors, which are respectively carried on a plurality of image bearers, are transferred to a recording sheet directly or through an intermediate transfer body. A transfer bias including an alternating current component is applied to a transfer bias member so as to transfer the toner images to the recording sheet. As the transfer bias, a transfer bias, in which the polarity of a pair of peak values in a peak-to-peak is a polarity that exhibits an electrostatic force in a transfer direction which moves toner from each of the image bearers or the intermediate transfer body toward the recording sheet, is applied.

Aspect K

According to Aspect K, there is provided an image forming apparatus including a plurality of image bearers which respectively carry toner images of different colors, an intermediate transfer body to which the toner images on the plurality of image bearers are transferred, and a power source that outputs a transfer bias including an alternating current component so as to transfer the toner images on the intermediate transfer body to the recording sheet. The transfer bias has a first peak value that is a peak close to a transfer direction in which toner is moved from the intermediate transfer body toward the recording sheet, and a second peak value that is different from the first peak value. A transfer mode includes a monochromatic mode in which a monochromatic toner image including only black toner is transferred to the recording sheet, and a color mode in which a color toner image including black toner and non-black toner other than the black toner is transferred to the recording sheet. In the color mode, the transfer bias, in which the second peak value has the same polarity as that of the first peak value, or is zero, is output. In the monochromatic mode, the transfer bias, in which the second peak value has a polarity opposite to that of the first peak value, or is zero, is output.

Aspect L

According to Aspect L, there is provided an image forming apparatus including a plurality of image bearers which respectively carry toner images, an intermediate transfer body to which the toner images on the plurality of image bearers are transferred, and a power source that outputs a transfer bias including an alternating current component so as to transfer the toner images on the intermediate transfer body to the recording sheet. The transfer bias has a first peak value that is a peak close to a transfer direction in which toner is moved from the intermediate transfer body toward the recording sheet, and a second peak value that is different from the first peak value. A transfer mode includes a first mode in which a toner image including toner on a most downstream-side image bearer among the plurality of image bearers is transferred to the recording sheet, and a second mode in which a toner image including toner on image bearers other than the most downstream-side image bearer is transferred to the recording sheet. In the second mode, the transfer bias, in which the second peak value has the same polarity as that of the first peak value, or is zero, is output. In the first mode, the transfer bias, in which the second peak value is zero or has a polarity opposite to that of the first peak value, is output.

Aspect M

According to Aspect M, there is provided an image forming apparatus including a plurality of image bearers which respectively carry toner images, an intermediate transfer body to which the toner images on the plurality of image bearers are transferred, and a power source that outputs a transfer bias including an alternating current component so as to transfer the toner images on the intermediate transfer body to the recording sheet. The transfer bias has a first peak value that is a peak close to a transfer direction in which toner is moved from the intermediate transfer body toward the recording sheet, and a second peak value that is different from the first peak value. A transfer mode includes a first mode in which only a minimum-charge-amount toner image, in which a toner charge amount immediately before being transferred to the recording sheet becomes the smallest among the toner images on the plurality of image bearers, is transferred, and a second mode in which toner images other than the minimum-charge-amount toner image are transferred to the recording sheet. In the second mode, the transfer bias, in which the second peak value has the same polarity as that of the first peak value, or is zero, is output. In the first mode, the transfer bias, in which the second peak value is zero or has a polarity opposite to that of the first peak value, is output.

Aspect N

According to Aspect N, there is provided an image forming apparatus. In the image forming apparatus, toner images of different colors, which are respectively carried on a plurality of image bearers (for example, the photoconductors 2), are transferred to a recording sheet directly or through an intermediate transfer body (for example, the intermediate transfer belt 31). A transfer bias including an alternating current component is applied to a transfer bias member (for example, the secondary-transfer first roller 33) so as to transfer the toner images to the recording sheet. Among the toner images of a plurality of colors, a color image including black toner and non-black toner different from the black toner is transferred to the recording sheet, or a monochromatic toner image including only the black toner is transferred to the recording sheet. Under an environment in which a frictional charge amount of toner is set to be relatively small, in the transfer bias that is applied, a polarity is periodically reversed both in the case of transferring the color toner image to the recording sheet and in the case of transferring the monochromatic toner image to the recording sheet. In the case of transferring the color toner image to the recording sheet under an environment in which the frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet. In the above-described configuration, as described in the second embodiment, it is possible to suppress occurrence of deficiency in an image density due to deficiency in a secondary transfer electric field while suppressing occurrence of deficiency in an image density due to injection of charges of the opposite polarity to toner regardless of the environment.

Aspect O

According Aspect O, there is provided an image forming apparatus. In the image forming apparatus, toner images, which are respectively carried on a plurality of image bearers which respectively carry toner images of different colors, are transferred to a recording sheet directly or through an intermediate transfer body. A transfer bias including an alternating current component is applied to a transfer bias member so as to transfer the toner images to the recording sheet. A most upstream-side toner image, which is carried on a most upstream-side image bearer that is firstly subjected to a toner image transfer process among a plurality of the image bearers, is transferred to the recording sheet, or only a most downstream-side toner image, which is carried on a most downstream-side image bearer that is finally subjected to the toner image transfer process, is transferred to the recording sheet. Under an environment in which a frictional charge amount of toner is set to be relatively small, in the transfer bias that is applied, a polarity is periodically reversed both in the case of transferring the most upstream-side toner image to the recording sheet and in the case of transferring only the most downstream-side toner image to the recording sheet. In the case of transferring the most upstream-side toner image to the recording sheet under an environment in which the frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet. In the above-described configuration, as described in Variation 2-1, it is possible to suppress occurrence of deficiency in an image density due to deficiency in a secondary transfer electric field while suppressing occurrence of deficiency in an image density due to injection of charges of the opposite polarity to toner regardless of the environment.

Aspect P

According to Aspect P, there is provided an image forming apparatus. In the image forming apparatus, toner images, which are respectively carried on a plurality of image bearers, are transferred to a recording sheet directly or through an intermediate transfer body. A transfer bias including an alternating current component is applied to a transfer bias member so as to transfer the toner images to the recording sheet. Among the toner images which are respectively carried on the plurality of image bearers, a maximum-charge-amount toner image, in which a toner charge amount immediately before being transferred to the recording sheet becomes the largest, is transferred to the recording sheet, or only a minimum-charge-amount toner image, in which the toner charge amount becomes the smallest, is transferred to the recording sheet. Under an environment in which a frictional charge amount of toner is set to be relatively small, in the transfer bias that is applied, a polarity is periodically reversed both in the case of transferring the maximum-charge-amount toner image to the recording sheet and in the case of transferring only the minimum-charge-amount toner image to the recording sheet. In the case of transferring the maximum-charge-amount toner image to the recording sheet under an environment in which the frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet. In the above-described configuration, as is described in Variation 2-2, it is possible to suppress occurrence of deficiency in an image density due to deficiency in a secondary transfer electric field while suppressing occurrence of deficiency in an image density due to injection of charges of the opposite polarity to toner regardless of the environment.

Aspect Q

According to Aspect Q, there is provided an image forming apparatus. In the image forming apparatus, toner images of different colors, which are respectively carried on a plurality of image bearers, are transferred to a recording sheet directly or through an intermediate transfer body. A transfer bias including an alternating current component is applied to a transfer bias member so as to transfer the toner images to the recording sheet. Among the toner images of a plurality of colors, a color toner image including black toner and non-black toner different from the black toner is transferred to the recording sheet, or a monochromatic toner image including only the black toner is transferred to the recording sheet. Under an environment in which a frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet both in the case of transferring the color toner image to the recording sheet and in the case of transferring the monochromatic toner image to the recording sheet. In the case of transferring the monochromatic toner image under an environment, in which the frictional charge amount of toner is set to be relatively small, to the recording sheet, in the transfer bias that is applied, a polarity is periodically reversed. In the above-described configuration, as described in the third embodiment, it is possible to suppress occurrence of deficiency in an image density due to deficiency in a secondary transfer electric field while suppressing occurrence of deficiency in an image density due to injection of charges of the opposite polarity to toner regardless of the environment.

Aspect R

According to Aspect R, there is provided an image forming apparatus. In the image forming apparatus, toner images, which are respectively carried on a plurality of image bearers which respectively carry toner images of different colors, are transferred to a recording sheet directly or through an intermediate transfer body. A transfer bias including an alternating current component is applied to a transfer bias member so as to transfer the toner images to the recording sheet. A most upstream-side toner image, which is carried on a most upstream-side image bearer that is firstly subjected to a toner image transfer process among a plurality of the image bearers, is transferred to the recording sheet, or only a most downstream-side toner image, which is carried on a most downstream-side image bearer that is finally subjected to the toner image transfer process, is transferred to the recording sheet. Under an environment in which a frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet both in the case of transferring the most upstream-side toner image to the recording sheet and in the case of transferring only the most downstream-side toner image to the recording sheet. In the case of transferring only the most downstream-side toner image under an environment, in which the frictional charge amount of toner is set to be relatively small, to the recording sheet, in the transfer bias that is applied, a polarity is periodically reversed. In the above-described configuration, as described in Variation 3-1, it is possible to suppress occurrence of deficiency in an image density due to deficiency in a secondary transfer electric field while suppressing occurrence of deficiency in an image density due to injection of charges of the opposite polarity to toner regardless of the environment.

Aspect S

According to Aspect S, there is provided an image forming apparatus. In the image forming apparatus, toner images, which are respectively carried on a plurality of image bearers, are transferred to a recording sheet directly or through an intermediate transfer body. A transfer bias including an alternating current component is applied to a transfer bias member so as to transfer the toner images to the recording sheet. Among the toner images which are respectively carried on the plurality of image bearers, a maximum-charge-amount toner image, in which a toner charge amount immediately before being transferred to the recording sheet becomes the largest, is transferred to the recording sheet, or only a minimum-charge-amount toner image, in which the toner charge amount becomes the smallest, is transferred to the recording sheet. Under an environment in which a frictional charge amount of toner is set to be relatively great, in the transfer bias that is applied, a peak-to-peak transitions only in a polarity that exhibits an electrostatic force that moves toner from each of the image bearers or the intermediate transfer body toward the recording sheet both in the case of transferring the maximum-charge-amount toner image to the recording sheet and in the case of transferring only the minimum-charge-amount toner image to the recording sheet. In the case of transferring only the minimum-charge-amount toner image under an environment, in which the frictional charge amount of toner is set to be relatively small, to the recording sheet, in the transfer bias that is applied, a polarity is periodically reversed. In the above-described configuration, as described in Variation 3-2, it is possible to suppress occurrence of deficiency in an image density due to deficiency in a secondary transfer electric field while suppressing occurrence of deficiency in an image density due to injection of charges of the opposite polarity to toner regardless of the environment.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a plurality of image bearers to bear toner images of different colors;

a transfer bias member to transfer the toner images from the plurality of image bearers onto a recording sheet directly or via an intermediate transfer body; and a power source to apply a transfer bias including an alternating current component to the transfer bias member to transfer the toner images onto the recording sheet, wherein, when the transfer bias member transfers a color toner image including black toner and non-black toner onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet, and wherein, when the transfer bias member transfers a monochromatic toner image including only the black toner onto the recording sheet, the second peak value is zero or has a second polarity to generate an electrostatic force in an opposite direction to the transfer direction.

2. The image forming apparatus according to claim 1, wherein, when the transfer bias member transfers the monochromatic toner image onto the recording sheet, an absolute value of the first peak value is smaller than an absolute value of the first peak value when the transfer bias member transfers the color toner image onto the recording sheet.

3. The image forming apparatus according to claim 2, wherein the second peak value has opposite polarities between when the transfer bias member transfers the color toner image onto the recording sheet and when the transfer bias member transfers the monochromatic toner image onto the recording sheet.

4. An image forming apparatus, comprising:

a plurality of image bearers to bear toner images of different colors;

a transfer bias member to transfer the toner images from the plurality of image bearers onto a recording sheet directly or via an intermediate transfer body; and a power source to apply a transfer bias including an alternating current component to the transfer bias member to transfer the toner images onto the recording sheet, wherein, when the transfer bias member transfers a most upstream toner image from a most upstream image bearer in a transfer process of the toner images onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet, and wherein, when the transfer bias member transfers only a most downstream toner image from a most downstream image bearer in the transfer process onto the recording sheet, the second peak value is zero or has a second polarity to generate an electrostatic force in an opposite direction to the transfer direction.

5. The image forming apparatus according to claim 4, wherein, when the transfer bias member transfers only the most downstream toner image onto the recording sheet, an absolute value of the first peak value is smaller than an absolute value of the first peak value when the transfer bias member transfers the most upstream toner image onto the recording sheet.

6. The image forming apparatus according to claim 5, wherein the second peak value has opposite polarities between when the transfer bias member transfers the most upstream toner image onto the recording sheet and when the transfer bias member transfers only the most downstream toner image onto the recording sheet.

7. An image forming apparatus, comprising:

a plurality of image bearers to bear toner images of different colors;

a transfer bias member to transfer the toner images from the plurality of image bearers onto a recording sheet directly or via an intermediate transfer body; and a power source to apply a transfer bias including an alternating current component to the transfer bias member to transfer the toner images onto the recording sheet, wherein, when the transfer bias member transfers onto the recording sheet a largest-charge-amount toner image having a largest charge amount of toner of the toner images before transfer onto the recording sheet, a second peak value of a peak-to-peak of the transfer bias, which is smaller than a first peak value of the peak-to-peak in an electrostatic force to move toner from the plurality of image bearers or the intermediate transfer body to the recording sheet, is zero or has a first polarity to generate the electrostatic force in a transfer direction to move toner from the plurality of image bearers or the intermediate transfer body to the recording sheet, and wherein, when the transfer bias member transfers onto the recording sheet only a smallest-charge-amount toner image having a smallest charge amount of toner of the toner images before transfer onto the recording sheet, the second peak value is zero or has a second polarity to generate an electrostatic force in an opposite direction to the transfer direction.

8. The image forming apparatus according to claim 7, wherein, when the transfer bias member transfers only the smallest-charge-amount toner image onto the recording sheet, an absolute value of the first peak value is smaller than an absolute value of the first peak value when the transfer bias member transfers the largest-charge-amount toner image onto the recording sheet.

9. The image forming apparatus according to claim 8, wherein the second peak value has opposite polarities between when the transfer bias member transfers the largest-charge-amount toner image onto the recording sheet and when the transfer bias member transfers only the smallest-charge-amount toner image onto the recording sheet.

10. An image forming apparatus, comprising:

an image bearer to bear a toner image;

an intermediate transfer body onto which the toner image is transferred; and a power source to output a transfer bias including an alternating current component to transfer during a transfer operation the toner image from the intermediate transfer body to a recording sheet, wherein the transfer bias output by the power source during the transfer operation alternates between positive and negative values when the image forming apparatus is in a monochromatic mode in which a monochromatic toner image including only black toner is transferred to the recording sheet, and wherein the transfer bias output by the power source during the transfer operation has a same polarity during the transfer operation when the image forming apparatus is in a color mode in which a color toner image including black toner and non-black toner other than the black toner is transferred to the recording sheet.

11. The image forming apparatus according to claim 10, wherein the image bearer includes a plurality of image bearers which respectively bear toner images of different colors.

12. The image forming apparatus according to claim 11, wherein a most downstream-side image bearer of the plurality of the image bearers bears a black color toner image.

13. The image forming apparatus according to claim 10, further comprising a transfer member to form a transfer nip between the intermediate transfer body and the transfer member.

14. The image forming apparatus according to claim 13, wherein the transfer member includes a secondary transfer belt.

15. The image forming apparatus according to claim 10, wherein the transfer bias includes a first peak value to move toner from the intermediate transfer body toward the recording sheet and a second peak value that is different from the first peak value.

16. The image forming apparatus according to claim 15, wherein an absolute value of the first peak value in the monochromatic mode is smaller than the absolute value of the first peak value in the color mode.

17. The image forming apparatus according to claim 15, further comprising:

a transfer member to form a transfer nip between the intermediate transfer body and the transfer member, and a roller to contact a back surface of the intermediate transfer body at the transfer nip, wherein the power source outputs the transfer bias to the roller, and wherein the first peak value has a same polarity as a normal charge polarity of the toner.

18. The image forming apparatus according to claim 10, wherein a peak-to-peak value of the transfer bias in the monochromatic mode is a same value as a peak-to-peak value of the transfer bias in the color mode.

19. The image forming apparatus according to claim 10, wherein the intermediate transfer body includes an intermediate transfer belt.

20. The image forming apparatus according to claim 19, wherein the intermediate transfer belt includes a base layer and an elastic layer disposed on the base layer, and particles are dispersed in the elastic layer.

* * * * *